US007503453B2

(12) United States Patent
Cronin et al.

(10) Patent No.: US 7,503,453 B2
(45) Date of Patent: Mar. 17, 2009

(54) MULTI-CHAMBER CONTAINER AND CAP THEREFOR

(75) Inventors: Jerry Cronin, Atlanta, GA (US); Stephen McMennamy, Atlanta, GA (US); Richard Bell, Atlanta, GA (US); Vlad Moise, Marietta, GA (US); Russell J. Kroll, Atlanta, GA (US); Suzuko Hisata, Atlanta, GA (US); Phil Palermo, Marietta, GA (US); Robert Henshaw, Newnan, GA (US)

(73) Assignee: Viz Enterprises, LLC, Atlanta, GA (US)

( * ) Notice: Subject to any disclaimer, the term of this patent is extended or adjusted under 35 U.S.C. 154(b) by 491 days.

(21) Appl. No.: 11/267,424

(22) Filed: Nov. 4, 2005

(65) Prior Publication Data

US 2006/0118435 A1 Jun. 8, 2006

Related U.S. Application Data

(60) Provisional application No. 60/624,931, filed on Nov. 4, 2004.

(51) Int. Cl.
*B65D 25/08* (2006.01)

(52) U.S. Cl. ..... 206/221; 215/DIG. 8

(58) Field of Classification Search ..... 206/219–222, 206/568; 215/DIG. 8; 222/1
See application file for complete search history.

(56) References Cited

U.S. PATENT DOCUMENTS

| | | | | |
|---|---|---|---|---|
| 179,461 | A | 7/1876 | Portemonnaies | |
| 3,599,845 | A | 8/1971 | Miller | |
| 3,924,741 | A | 12/1975 | Kachur et al. | |
| 4,024,952 | A * | 5/1977 | Leitz | 206/221 |
| 4,253,588 | A | 3/1981 | Lester et al. | |
| 4,315,570 | A | 2/1982 | Silver et al. | |
| 5,217,433 | A * | 6/1993 | Bunin | 206/221 |
| 5,255,812 | A | 10/1993 | Hsu | |
| 5,277,303 | A * | 1/1994 | Goyet et al. | 206/221 |
| 5,337,931 | A | 8/1994 | Kitterman | |
| 5,794,802 | A | 8/1998 | Caola | |
| 5,863,126 | A | 1/1999 | Guild | |
| 5,908,107 | A * | 6/1999 | Baudin | 206/221 |
| 5,950,819 | A | 9/1999 | Sellars | |
| 5,967,309 | A | 10/1999 | Robles-Gonzalez et al. | |
| 6,003,728 | A * | 12/1999 | Elliott | 206/219 |

(Continued)

OTHER PUBLICATIONS

Instant Mixer Cap—The Revolutionary Instant Drink Dispensing System, downloaded from various locations indicated on pages from http://www.instantmixercap.com on Dec. 11, 2007 and Jan. 6, 2008, 6 pages.

(Continued)

*Primary Examiner*—Luan K Bui
(74) *Attorney, Agent, or Firm*—Greenblum & Bernstein, P.L.C.

(57) ABSTRACT

A dispenser comprises a housing that has a removable tamper proof protective cap and tamper proof ring and is threaded to a container. The container, which is the main package, holds the supplemental component. The housing holds the first component into a plunger type chamber in a fully retracted position and is sealed from the supplemental component. The chamber has a delivery end that is closed before use. When pushed all the way in, the chamber's delivery end becomes open and delivers the first component into the main package.

49 Claims, 13 Drawing Sheets

U.S. PATENT DOCUMENTS

| | | | | |
|---|---|---|---|---|
| 6,098,795 | A | 8/2000 | Mollstam et al. | |
| 6,105,760 | A | 8/2000 | Mollstam et al. | |
| 6,149,866 | A | 11/2000 | Luotola et al. | |
| 6,209,718 | B1 | 4/2001 | Mollstam et al. | |
| 6,230,884 | B1 | 5/2001 | Coory | |
| 6,257,428 | B1 | 7/2001 | Caola | |
| 6,257,453 | B1 | 7/2001 | Graham | |
| 6,257,463 | B1 | 7/2001 | DePolo | |
| 6,375,041 | B1 * | 4/2002 | Klima et al. | 206/222 |
| 6,387,073 | B1 | 5/2002 | Weiler et al. | |
| 6,435,341 | B1 | 8/2002 | Nobbio | |
| 6,513,650 | B2 | 2/2003 | Mollstram et al. | |
| RE38,067 | E | 4/2003 | Gueret | |
| 6,609,634 | B2 | 8/2003 | De Laforcade et al. | |
| 6,644,471 | B1 | 11/2003 | Anderson | |
| 6,679,375 | B1 | 1/2004 | Coory | |
| 6,705,490 | B1 | 3/2004 | Lizerbram et al. | |
| 6,705,491 | B1 | 3/2004 | Lizerbram et al. | |
| 6,763,939 | B2 | 7/2004 | Alticosalian | |
| 6,772,910 | B1 | 8/2004 | Coory | |
| 6,854,595 | B2 | 2/2005 | Kiser | |
| 6,886,686 | B2 | 5/2005 | Anderson | |
| 6,921,087 | B2 | 7/2005 | Takahashi et al. | |
| 6,926,138 | B1 | 8/2005 | Basham et al. | |
| 7,032,745 | B2 | 4/2006 | Saulle | |
| 7,055,684 | B2 | 6/2006 | Anderson | |
| 7,249,690 | B2 | 7/2007 | Smith et al. | |
| 2002/0040856 | A1 | 4/2002 | Mollstam et al. | |
| 2003/0072850 | A1 | 4/2003 | Burniski | |
| 2004/0112770 | A1 | 6/2004 | Oswald | |
| 2004/0200740 | A1 | 10/2004 | Cho | |
| 2004/0200741 | A1 | 10/2004 | Cho | |
| 2005/0115845 | A1 | 6/2005 | Cho | |
| 2005/0173271 | A1 | 8/2005 | Levi | |
| 2005/0236424 | A1 | 10/2005 | Walters et al. | |
| 2006/0006077 | A1 | 1/2006 | Mosher et al. | |

OTHER PUBLICATIONS

Liquid Health Labs, Inc.—building a brand with a twist, downloaded from http://www.liquidhealthlabs.com/NAVIGATION/technology.html, on Dec. 11, 2007, 1 page.

BevNET.com Classified Ad—POWERCAP—Dosing System for Enhanced Beverages, downloaded from http://www.bevnet.com/classifieds/ad/6B76A1A0A9304EF0890F8389C0F05B15 on Dec. 11, 2007, 1 page.

Erie Plastics, Pop N' Shake downloaded from http://www.erieplastics.com/programs_details.php?program_page=2 on Jan. 21, 2008, 2 pages.

Pop N' Shake™ Refresh, Replenish, Reinvigorate, White Paper downloaded from http://www.erieplastics.com/cms/uploads/tradetools/PopNShakeWhitePaper2-2.pdf, on Dec. 11, 2007, 5 pages.

Pop N' Shake Video page downloaded from http://www.erieplastics.com/popnshake on Jan. 21, 2008, 1 page.

Tabnology—the link between Health and Convenience, SwissCo Pharma & Food Supplements, downloaded from http://www.swissco.ch/index.php?id=20&L=0&L=1 on Jan. 6, 2008, 1 page.

Ikon the Ultimate innovation to increase your drink market share, tabnology europe, downloaded from http://www.swissco.ch/fileadmin/inhalte/dokumente/IkonPresentation_e.pdf on Jan. 6, 2008, 13 pages.

Freshmix Cap Systems System Outline, 9 pages, date unknown.

* cited by examiner

MULTI-CHAMBER CONTAINER AND CAP THEREFOR

This application claims the benefit of the filing date of provisional application Ser. No. 60/624,931, filed Nov. 4, 2004.

BACKGROUND OF THE INVENTION

This invention concerns a dispensing closure such as a container; especially containers that have at least two chambers that may be used to keep at least two components, such as a liquid and a powder or tablets, separated until time for use.

Many different styles of caps, lids and closures have been well documented and described in the prior art. They include tamper proof closures, caps that seal the container using a check valve taking advantage of the squeeze action of a flexible bottle to create the pressure differential to activate the valve, and other devices. Also prior art concerning containers with two compartments, separating two ingredients to be mixed before consumption, exist; but few if any of these containers are commercially available mostly because of complicated parts, difficulty of filling and high manufacturing cost.

Many of these devices consist of a piercing tip or cutter that perforates or cuts a foil seal, blister pack or membrane releasing one component into a supplemental component, usually tablets, granules or powders into a liquid. Minor differences, consisting mostly of how the piercing tip is activated, differentiate these devices. Whether piercing tips or cutters are used to remove the seal between compartments, there is always the danger of having fragments of foil or other residue fall into the mixed components.

This invention provides a container and cap that overcome many of the disadvantages of the prior art while providing a container that is easy to use and uses a minimum number of parts and that is simple to manufacture and assemble.

SUMMARY OF THE INVENTION

This invention is a device and means to add a selected component to a main package or chamber. It forms a two-chamber container that keeps the first component separated from the main component, in an air tight sealed manner until a selected time before use. If the first component is moisture sensitive, means are provided to include desiccant granules in the housing that contains the first component.

In an embodiment, the device comprises a cap or delivery package that is mounted on a threaded neck of a container (bottle) main body that contains the main component, preferably a liquid.

The cap has a fixed member that attaches to the container main body and a movable member that holds the supplemental component. In a fully retracted position, the movable member is sealed against the fixed member and held in place until enough force is applied to unlock and push down the top flange of plunger until it bottoms up against a fixed member seat. When that happens, openings at the bottom of the movable member (delivery end) become unsealed and the first component is dispensed into the main package. The housing is then removed from the main package and the two mixed components are ready to use.

In a further embodiment, the device consists of a similar cap or housing that is provided with a built in liquid dispensing attachment (sipper) that allows the use of the mixed components without removing the cap or housing from the main package.

The invention provides means to attach a first compartment to a main package after both have been manufactured and filled. For example vitamins, minerals, nutrients or medicine can be added to liquid beverage bottles in the form of effervescent powders or granules at or just before the time the beverage is consumed.

In a further embodiment, the invention provides for a container comprising a container main body providing a first chamber for holding a liquid and having an opening, a container cap mounted at the opening of the container main body, the cap including a plunger having an open end and a closed end and a second chamber formed therebetween for holding a component, the closed end formed by a lid, the plunger having a locking member wherein the plunger, lid and locking member are all formed of one piece, a cap body having a bore formed by an inner wall having a first structure and the plunger mounted within the bore and movable from a storage condition to an activated condition so that in the storage condition the locking member engages the first structure and a dispensing tip mounted in the bore adjacent the plunger and the plunger activates the dispensing tip to move between a closed position to an open position allowing the component in the second chamber to be dispensed into the first chamber.

In an embodiment, the open end of the plunger may abut against the cylindrical collar of the dispensing tip and upon actuation of the plunger from the storage condition to the activated condition the open end abuts against the collar and pushes the dispensing tip from the closed to the open position in order to break the seal of the dispensing tip and allow for the component to be dispensed from the second chamber to the first chamber of the main body. In an embodiment, the container cap may include a tear strip which provides for both a compression barrier in order to maintain the lid in the storage condition when the tear strip is attached to the cap and a tamper evident component that provides for a visible indication once the tear strip is removed.

In an embodiment, the tear strip may be formed as one piece with the plunger and includes a perforated area adjacent on the edge of the cap to allow for removal of the tear strip. In an embodiment, the container cap may include a desiccant cylinder snap fit within the cap. In an embodiment, the component may include granules having at least two different weights, the granules contained within the second chamber when the plunger is in the storage condition. In an embodiment, the lid may be a solid member that permanently encloses the second chamber and is integrally formed with the plunger. In an embodiment, the locking member includes an annular flange protruding from the plunger and the first structure being an annular groove formed in the inner wall and for receiving the annular flange in the storage condition. In an embodiment, the inner wall may include a second structure having an annular groove formed in the inner wall below the first structure and for receiving the annular flange when the plunger is moved to the activated condition in order to lock the plunger in the activated condition.

In an embodiment, the locking member may include a first tapered wall formed on an outer plunger wall and the first structure including a second tapered wall of the cap body and upon moving of the plunger to the activated condition, the first tapered wall engaging the second tapered wall in order to provide a luer lock effect in order to lock the plunger in the activated position. In an embodiment, the first tapered wall of the cap body has a slope equal to the slope of the second tapered wall of the plunger. In an embodiment, the dispensing tip may include a cylindrical collar having an annular flange protruding therefrom and reciprocating within the bore of the cap body between the open and closed positions and the annular flange engaging an annular lip formed at the open end in order to lock the dispensing tip in the open position.

In an embodiment, the dispensing tip may include apertures formed therein for dispensing of the component from the second chamber to the first chamber. In an embodiment, the dispensing tip may include a transverse base member having a generally conical shaped upper surface to allow for the component to be dispensed easily through the open end of the cap. In an embodiment, the cap body may include an outer collar forming a threaded receptacle for mounting the cap onto the container main body. In an embodiment, the cap body may include threads having vents formed therein. In an embodiment, storage condition may provide for an air tight seal for the second chamber.

In an embodiment, the plunger may include a locking lug and the cap body includes a key way for engaging the locking lug in order to prevent axial rotation of the plunger. In an embodiment, the lid may form a soft shaped target surface. In an embodiment, the dispensing tip may include a labyrinth seal that restricts air and moisture from passing into the second chamber. In an embodiment, the dispensing tip may include a dielectric seal in the storage condition. In an embodiment, the dielectric seal may be adjustably securable so that during manufacture of the container the amount of energy directed toward the dispensing tip may be controlled in order to adjust the pull strength of the seal. In an embodiment, the container and cap may provide for a modular system that may be removed from the container main body without adjusting the plunger from the storage condition and preventing the dispensing tip to move from the closed position so that the cap may be shipped separate from the container main body and also so that the volume of the liquid in the first chamber can be adjusted while the cap is removed and without affecting the amount of component within the second chamber of the cap.

In a further embodiment, a cap is provided comprising a cap body having an open end and a closed end formed by a lid, and a dispenser tip mounted at the open end and reciprocatable between an open and a closed position and in the closed position, in at least a first operation, the dispenser tip forming a seal at the open end and upon activation of the dispenser tip the seal being broken and providing a first audible sound indicative of the dispenser tip being in the open position. In an embodiment, the lid may be moveable between a storage condition and an activated condition by pushing downward on the lid with an operator's hand and the lid being hard and smooth in order to provide a resonant surface so that upon activation of the lid with the operator's hand a second audible sound is provided indicative of the lid being moved to the activated condition. In an embodiment, the lid may include a transparent dome. In an embodiment, the lid may include indicia identifying the contents of the container.

In an embodiment, the first and second audible sounds may occur approximately simultaneously to provide a dual activation opening sound. In an embodiment, the seal may be provided by a dielectric seal formed between an edge of the dispenser tip and the open end of the cap body. In an embodiment, the seal may be provided by mechanically locking the dispenser tip against the open end of the cap body. In an embodiment, the dispenser tip may be generally conical shaped and includes an annular edge forming a first flat, sealing surface and the cap body forming an annular rim at the open end and the rim forming a second flat, sealing surface for abuttingly receiving the first flat, sealing surface thereon in the closed position. In an embodiment, a dielectric seal may be provided between the first and second flat, sealing surfaces that can withstand a pull force of about 250-1,000 grams.

In an embodiment, the dispenser tip may include an upper ring having an annular flange protruding in a direction parallel to the annular edge and the cap body including an annular groove for receiving the annular flange in order to lock the dispensing tip in the closed position and seal the first flat sealing surface against the second flat sealing surface. In an embodiment, upon moving the dispenser tip from the closed position to the open position the annular flange may be displaced from the annular groove and provides the first audible sound due to the compression and decompression of material forming the annular flange. In an embodiment, the dispenser tip may be generally conical shaped and includes an annular edge forming a first flat, sealing surface and the cap body forming an annular rim at the open end and the rim forming a second, flat sealing surface for abuttingly receiving the first flat, sealing surface thereon in the closed position and the first audible sound is provided by both the breaking of the dielectric seal and the disengagement of the annular flange from the annular groove.

In another embodiment, a method of providing effervescence in a container is provided comprising the steps of providing a container having a first chamber for holding a liquid and second chamber holding a component, filling the first chamber at least partially with liquid, filling the second chamber at least partially with the component, wherein the component is formed of a first component having a first weight or shape and a supplemental component having a second weight or shape, activating the container so that the first chamber is in communication with the second chamber and dispensing the component from the second chamber to the first chamber and the component being dispersed into the liquid so that the first component is dispersed to a first location in the liquid that is apart from a second location to which the supplemental component is dispersed, wherein the component is activated by the liquid and causes an effervescence within the first chamber at the first and second locations.

In an embodiment, the first weight may be between about 0.5 to 2 grams and the second weight is between about 2 to 5 grams. In an embodiment, the first shape may be a sphere and the second shape is a cube. In an embodiment, the component may be a tablet including an ingredient including one of a Creatine, wolfberry, calcium, guarine, arginine, Vitamins B, B12, C, D, ibuprofen, electrolytes, niacin, folic acid, biotin, choline bitartate, inositol, manganese, calcium, Saint John's wart, yohimbe, chromium polynicotinate, carnitine, taurine, astragulus, schizandra, kava kava, lemon grass, Echinacea, prolione, bee pollen, amino acids and zinc. In an embodiment, the first component may include an ingredient different than the supplemental component. In an embodiment, the second chamber may be provided by a cap that is securely attached to the container so that increase in pressure in the first chamber due to effervescence cannot cause the cap to pop off the container.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION

Figure 1:
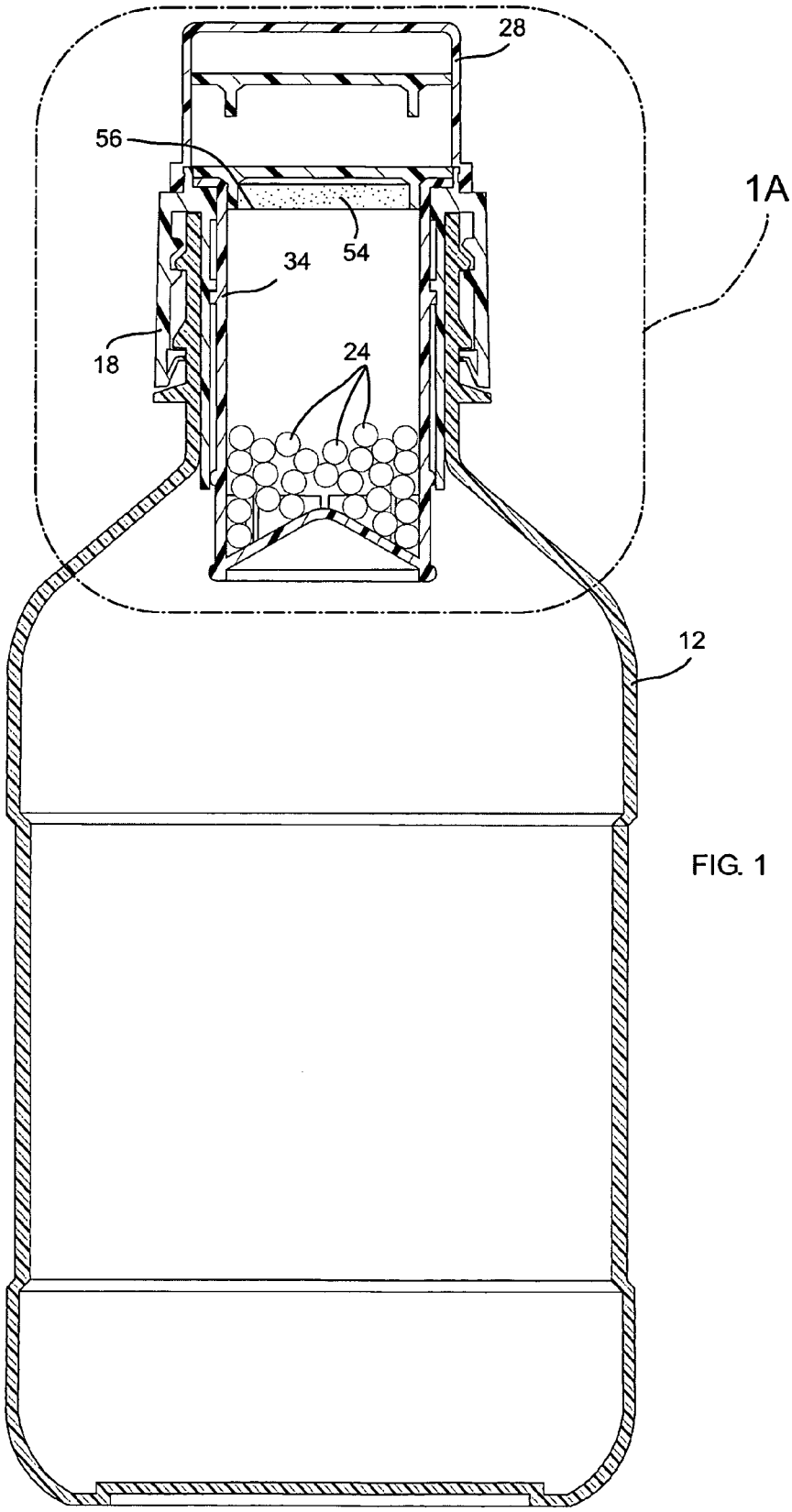
FIG. 1 is a cross-sectional view of the first embodiment of the cap invention attached to the main package, in this case a bottle, before the device is activated.

A first embodiment of the invention is depicted with respect to FIGS. 1-4B. In FIG. 1, the dispensing closure or cap 10 is shown in use with a plastic container 12 which contains a main component such as water or a variety of different fluids. The container 12 or main package has a threaded neck 14 to which the dispensing closure 10 is mounted using internal threads 16, FIG. 4, included in the container cap or body 18. The container cap 18 or cap is serrated 80, (FIG. 4), in order to facilitate the assembly and disassembly of the dispensing closure 10 to the container 12.

The container cap 18 is provided with a tamper proof ring 20 that locks behind a collar 22 built into the container neck 14, when the dispensing closure 10 is threaded all the way in. When removing the dispensing closure 10 after the first component 24 has been added to the container 12, the tamper proof ring 20 remains locked behind the collar 22 and the unscrewing motion provides enough force to break thin protrusions 26 FIG. 4 that attach the tamper proof ring 20 to the container cap 18. If the dispensing closure 10 has not been activated but the tamper proof ring 20 is loose, that will provide a visual indication that the container has been opened before being ready for use. An example of a supplemental or first component 24 that may be used are vitamins, minerals, nutrients or medicine. The first component 24 may be in the form of effervescent granules or powder could be formulated to address specific needs and markets such as:

POWER: Creatine, wolfberry, calcium, guarine, arginine, vitamin C and B

POST WORK OUT: ibuprofen, electrolytes

VITAMIN SUPPLEMENT: B1, niacin, folic acid, Biotin, choline bitartrate, inositol, manganese VITAMIN CHARGE: vitamins B, B12, C and D BONE HEALTH: calcium STRESS: Saint John's Wort, wolfberry ENERGY: yohimbe, chromium polynicotinate, carnitine, taurine, astragulus, vitamin C CALM: schizandra, kava kava, lemongrass HEALTH/COLD PREVENTION: echinacea, prolione, wolfberry, bee pollen, amino acids, zinc.

The top of the container cap 18 has means of attaching a tamper proof protective cap 28. Corresponding meshing teeth 30 FIG. 4 prevent the protective cap 28 from rotating while a ring/groove combination 32 insure that it can not separate from the container cap 18 until reasonable force is applied. Similar thin protrusions 26 found in the tamper proof ring 20 are used in the protective cap 28 design. Attachment of the protective cap to the container cap is not shown in detail since it is based on a design well known to those of skill in the art.

A movable member, plunger or first component holder 34 comprises the second part of the assembly. When inserted into the container cap 18, it locks in place in the retracted position by means of a lock ring 36 matched with a lock groove 38 provided in the container cap 18. The bottom of the lock ring 36 is sloped while the top is flat. The same configuration is used for the lock groove 38; thus, insuring that less force is required to push the first component holder 34 and greater force is required to pull it out of the container cap 18. This construction acts to indicate to the user that the first component holder can move only one way and, in this embodiment of the invention, it can not be retracted after the first component has been dispensed. An additional safety feature is also provided by means of a container cap lock ring 40 below the container cap lock groove 38.

Assembly components my be formed or manufactured by any means known in the art. For example, bottles may be blow molded. The container cap, the first component holder and the protective cap may be injection molded. All parts may be made of FDA approved materials. Materials may include Low Density Polyethylene (LDPE), High Density Polyethylene (HDPE), Polypropylene (PP), Rigid Polyvinyl Chloride (PVC), Polyester and Co-Polyester (PET and PET-G), Styrene Acrylonitrile (SAN), Polystyrene (PS).

The cap 10 of the device may be assembled separate from the bottle and attached to the bottle after it has been filled with the first component or on the bottle during manufacturing process. In the first case, the first component holder 34 is inserted into the container cap 18 until the lock ring 36 snaps into the lock groove 38. Next the first component 24 is premeasured and dispensed into the first component holder 34. Separately, the holder cap 52 is filled with desiccant granules 54, if the first component is moisture sensitive, and the wire or plastic mesh 56 is attached to it.

The assembled holder cap 52 is then attached to the first component holder 34. Permanent attachment can be achieved by any means available such as solvent or adhesive bonding, ultrasonically welding, heat staking, press fit insertion, threads or fasteners. The most economical and practical method should be selected.

The protective cap 28 is then snapped onto the container cap 18; thus, completing the assembly. The assembled dispensing closure 10 is then screwed on the container 12 until the tamper proof ring 20 locks behind the collar 22.

If it is determined, in the bottling process, that the dispensing closure 10 has to be assembled on the container, a slightly different procedure must be followed. After the container has been filled with the supplemental component, the container cap 18 is first screwed on the container 12 until the tamper proof ring 20 locks behind the collar 22. Then the steps outlined in the above assembly sequence are followed until the protective cap 28 is snapped onto the container cap 18 thus completing the assembly.

The liquid dispensing attachment (sipper) requires a more detailed assembly procedure since it has more parts. The basic steps are the same as discussed above. The assembly starts with the container cap 18 that may be attached to the container 12 or may be at a separate location. The first component holder 68 is then inserted into the container cap 18 until the lock ring 86 lock into the lock groove 98. The first component holder 68 may be in this case, an assembly, where the sipper tube 70 is attached to its inner wall. The pre-measured first component 90 is then dispensed into the first component holder 68. The sipper cap 62 is attached next to the first component holder 68. The sipper cap 62 may have the sipper pull sleeve 74 already attached or it may be inserted as a separate assembly step. Snapping the protective cap 64 onto the sipper cap 62 completes the assembly.

Figure 1A:
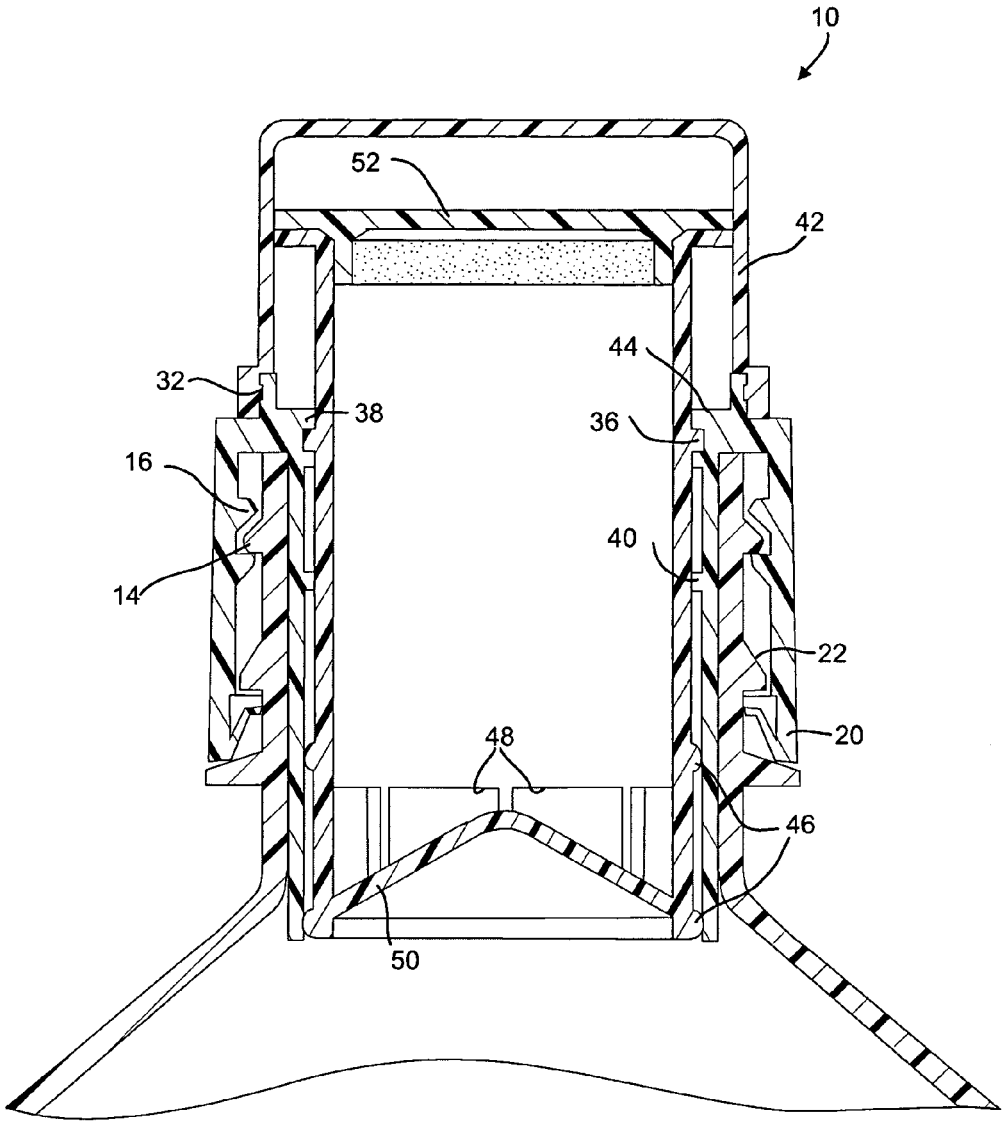
FIG. 1A is an enlarged view of the component features of the cap of FIG. 1.
Figure 2:
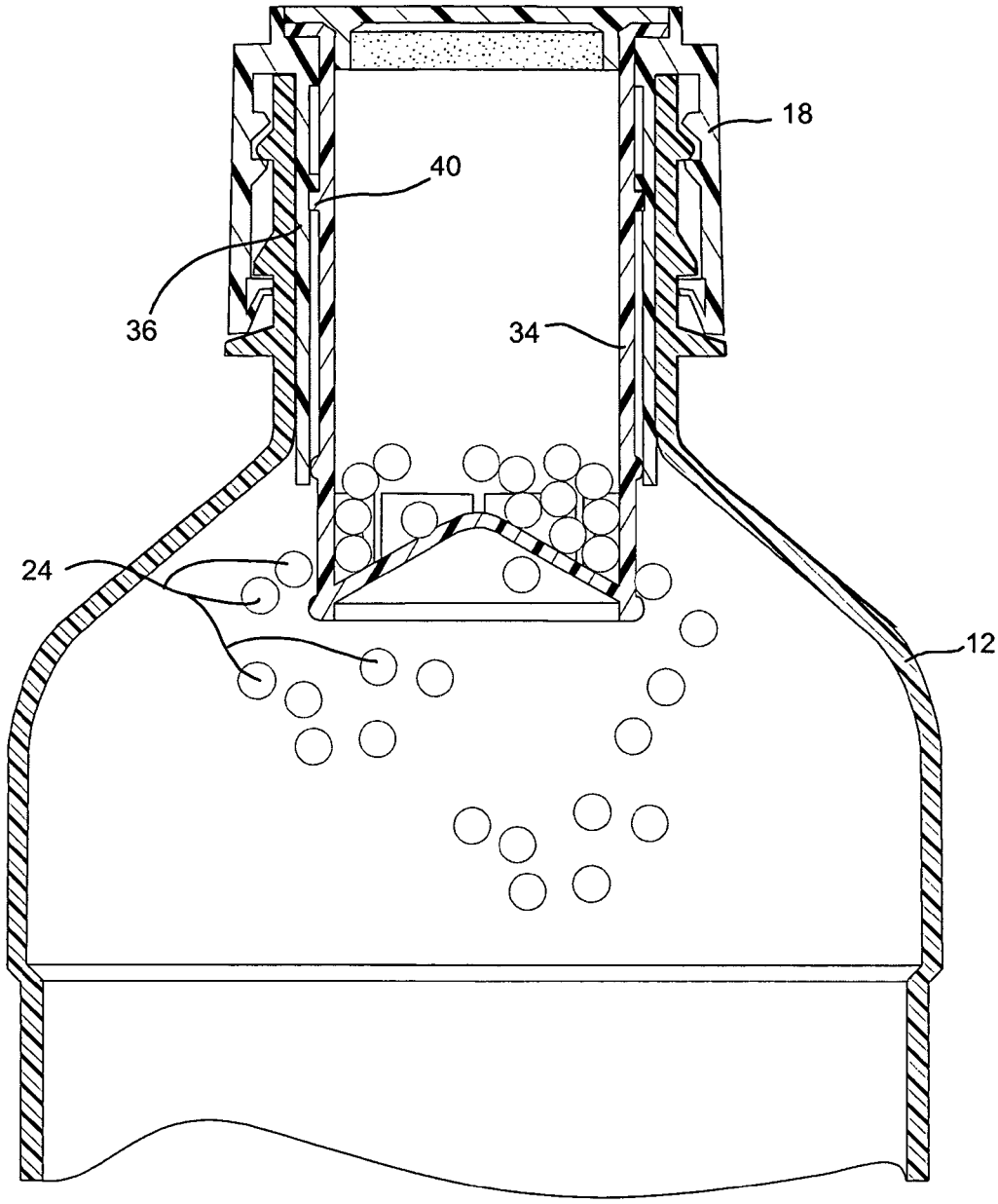
FIG. 2 is an enlarged cross-sectional view of the cap of FIG. 1 after the device has been activated and the first component dispensed into the main package.
Figure 3A:
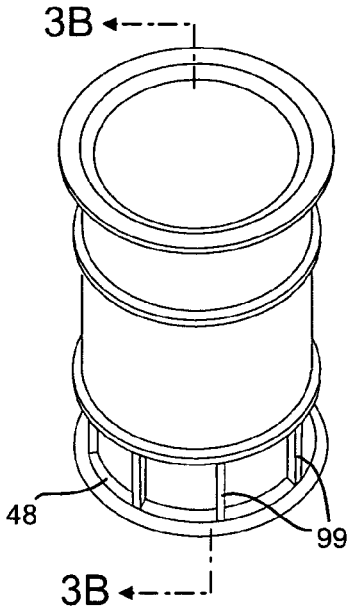
FIG. 3A is a perspective view of the movable member of the cap of FIG. 1 showing the delivery end and seals.
Figure 3B:
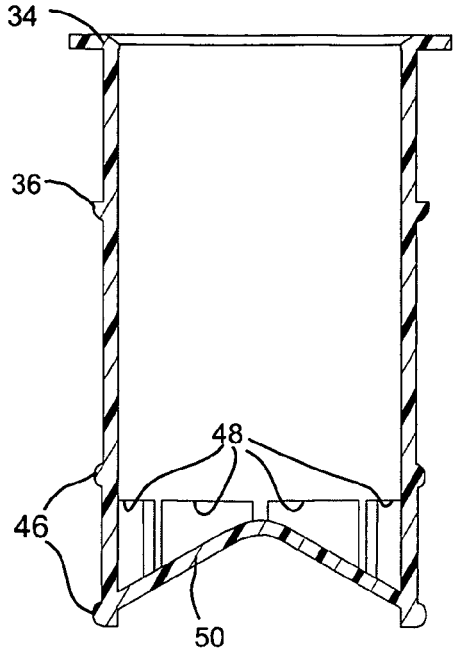
FIG. 3B is a cross-sectional view of FIG. 3A, taken at line 3B-3B.

At the end of the first component holder 34 (FIGS. 1 and 1A), when the top flange 42 bottoms out into the container cap seat 44, the lock ring 36 moves below the container cap lock ring 40 which has a flat bottom effectively securing the first component holder 34 in place.

The first component holder 34 is also provided with two seal rings 46 that create an air tight fit with the container cap inner wall. A combination of wall thickness and material flexibility allow the seal rings 46 to pass over the ring/groove combination 32 and container cap lock ring 40 in the container cap 18 when the first component holder 34 is inserted into the container cap 18.

Between the seal rings 46, openings are provided into the first component holder 34 wall. These openings 48 constitute the dispensing end of the first component holder 34, FIG. 3. When the device is activated FIG. 2 the dispensing end travels below the container cap 18 wall and the first component 24 is released into the container 12. Before activation, the tamper proof protective cap 28 must be removed by snapping it off.

The dispensing end of the first component holder 34 has a tapered bottom that also helps dispensing the first component 24 into the container 12. The tapered bottom has a conical shape and it is angled as such as to allow gravity to dispense the first component. The openings 48 are designed to maximize the first component dispensing area. Therefore the cross section of the legs 99 that attach the tapered bottom to the main body of the first component holder is kept to a minimum. The number of openings may also vary if it is determined that less openings with fewer legs are desirable.

The first component 24 is loaded into the first component holder 34 after the holder has been inserted into the container cap 18 and is locked in the retracted position by means of the ring/groove combination 32.

To complete the assembly, a holder cap 52 is attached to the top of the first component holder 34. The holder cap 52 may contain desiccant granules 54 held in place by a wire or plastic mesh 56 that will allow airflow through if the first component is moisture sensitive.

Figure 5:
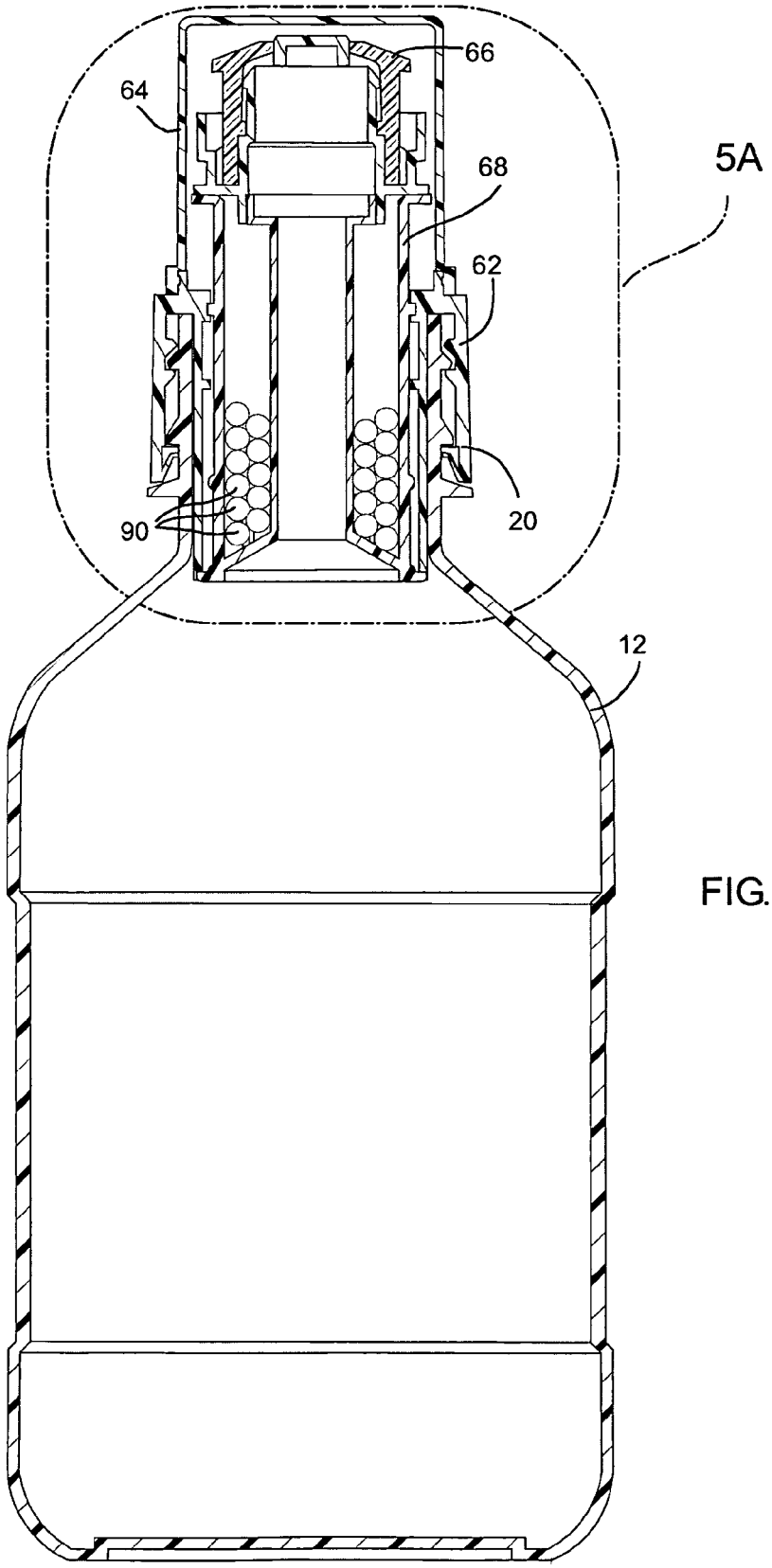
FIG. 5 is a cross-sectional view of a second embodiment of the cap invention attached to the main package, before the device is activated.
Figure 5A:
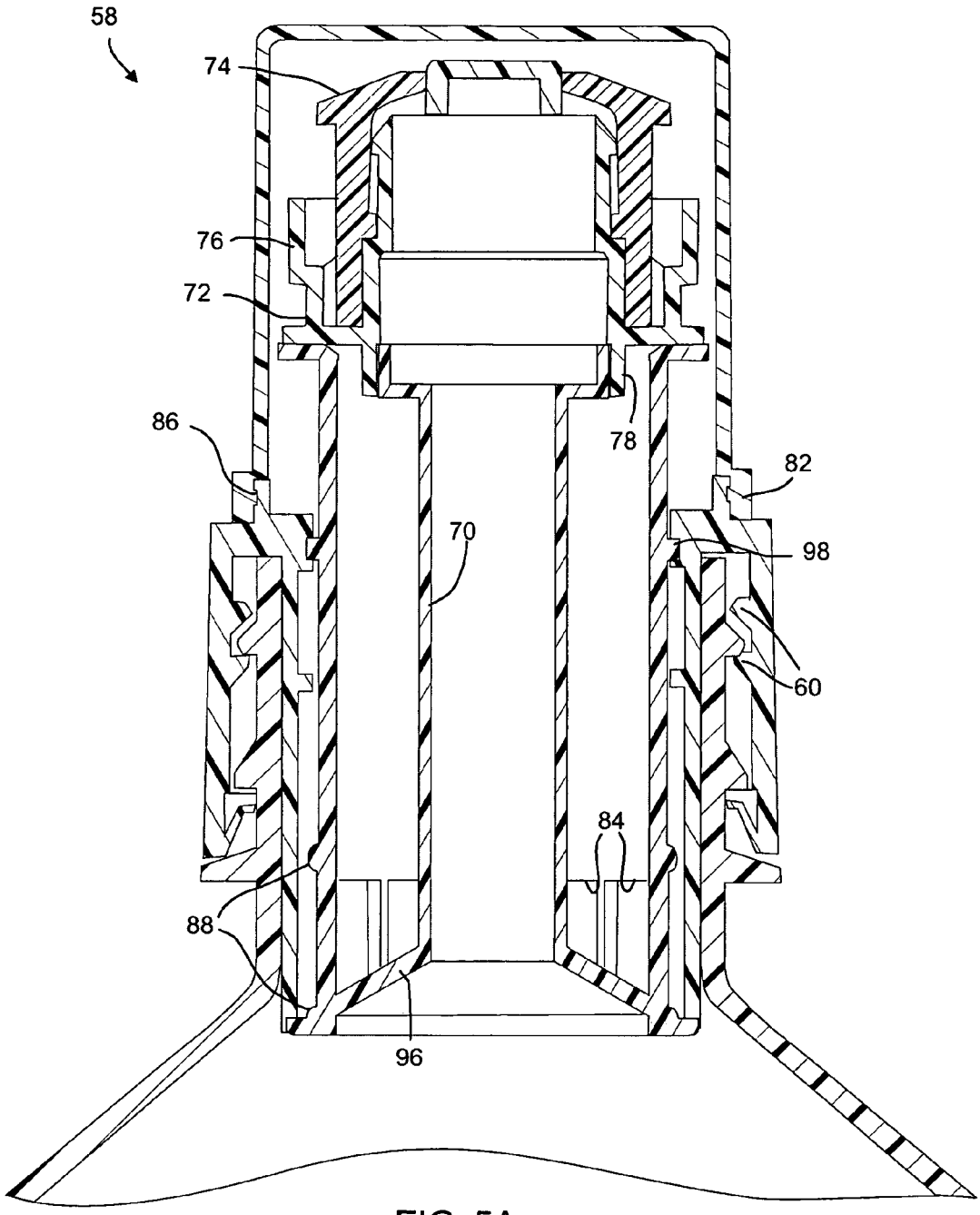
FIG. 5A is an enlarged detail view of the cap of FIG. 5.

In FIG. 5 the second embodiment of the invention is shown in the closed position, before the device is activated. As in the first embodiment, the dispensing closure 58 is attached to the container 12, plastic bottle, by means of internal threads 60, provided in the sipper cap 62 or container cap.

Figure 4A:
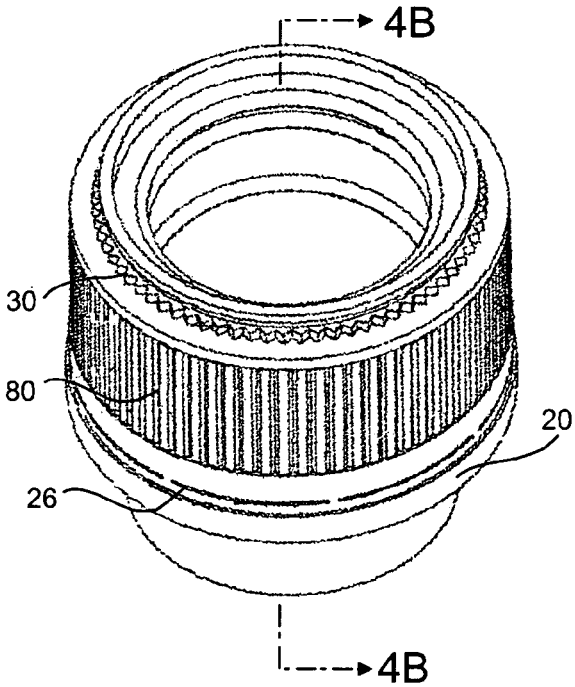
FIG. 4A is a perspective view of the fixed member of the cap of FIG. 1 showing the lock ring and provisions for the protective cap.
Figure 4B:
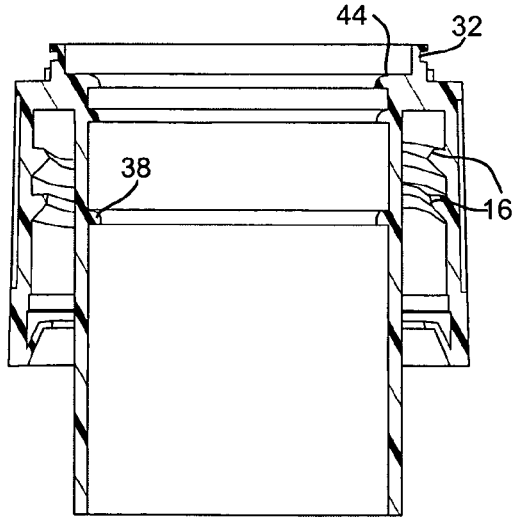
FIG. 4B is a cross-sectional view of FIG. 4A, taken at line 4B-4B.

The sipper cap 62 of the second embodiment provides the same features as the container cap 18 of the first embodiment namely tamper proof ring 20 attached with thin protrusions to the sipper cap 62, means of attaching a protective cap 64 (corresponding meshing teeth 30, ring/groove combination attachment), serrations 80, FIG. 4, for ease of assembly. The internal wall of the sipper cap 62 has the same lock groove 98, but the second container cap lock ring 40 has been eliminated in this configuration.

Figure 6:
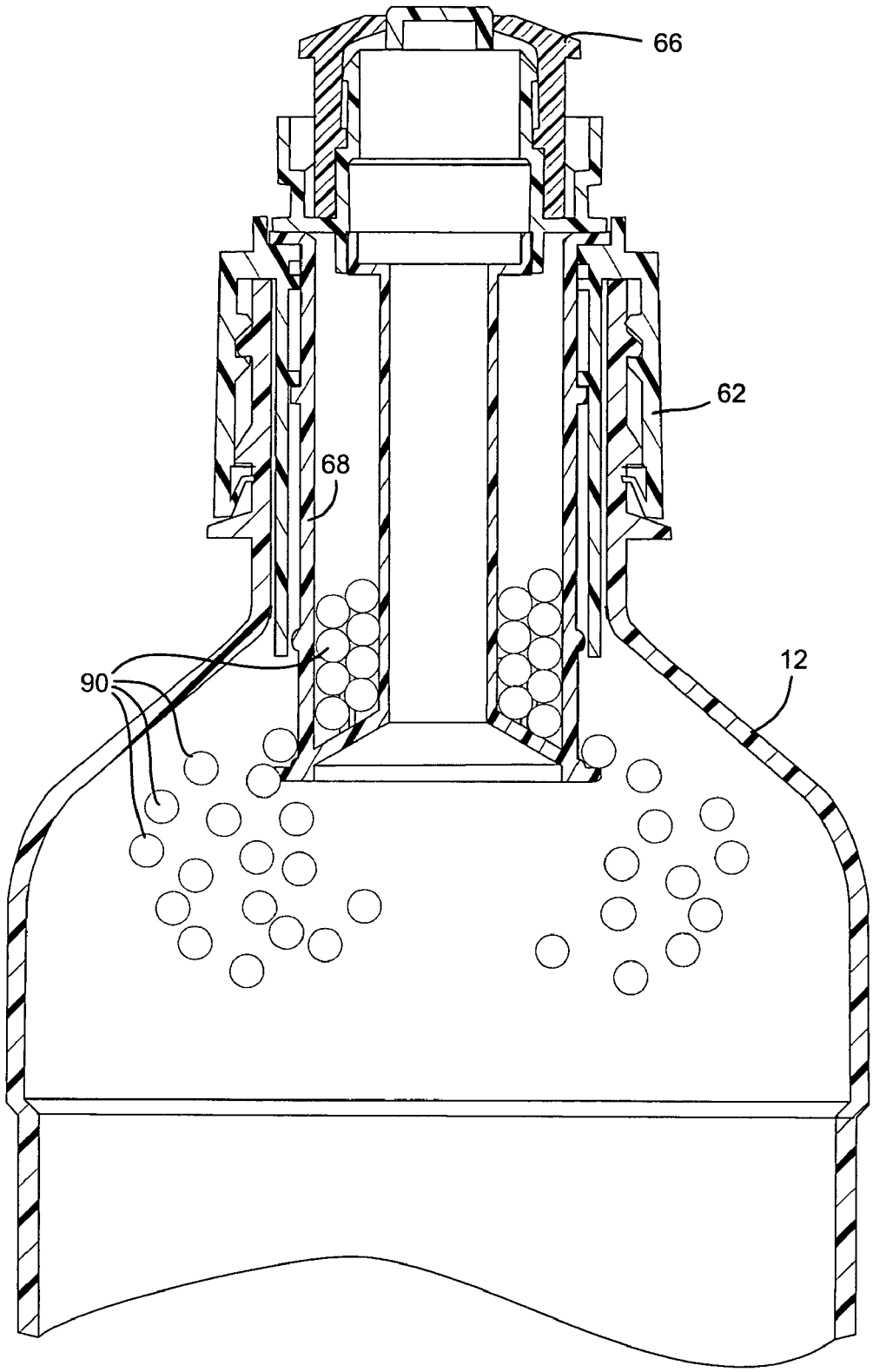
FIG. 6 is an enlarged cross-sectional view of the cap of FIG. 5 after the device has been activated.
Figure 7:
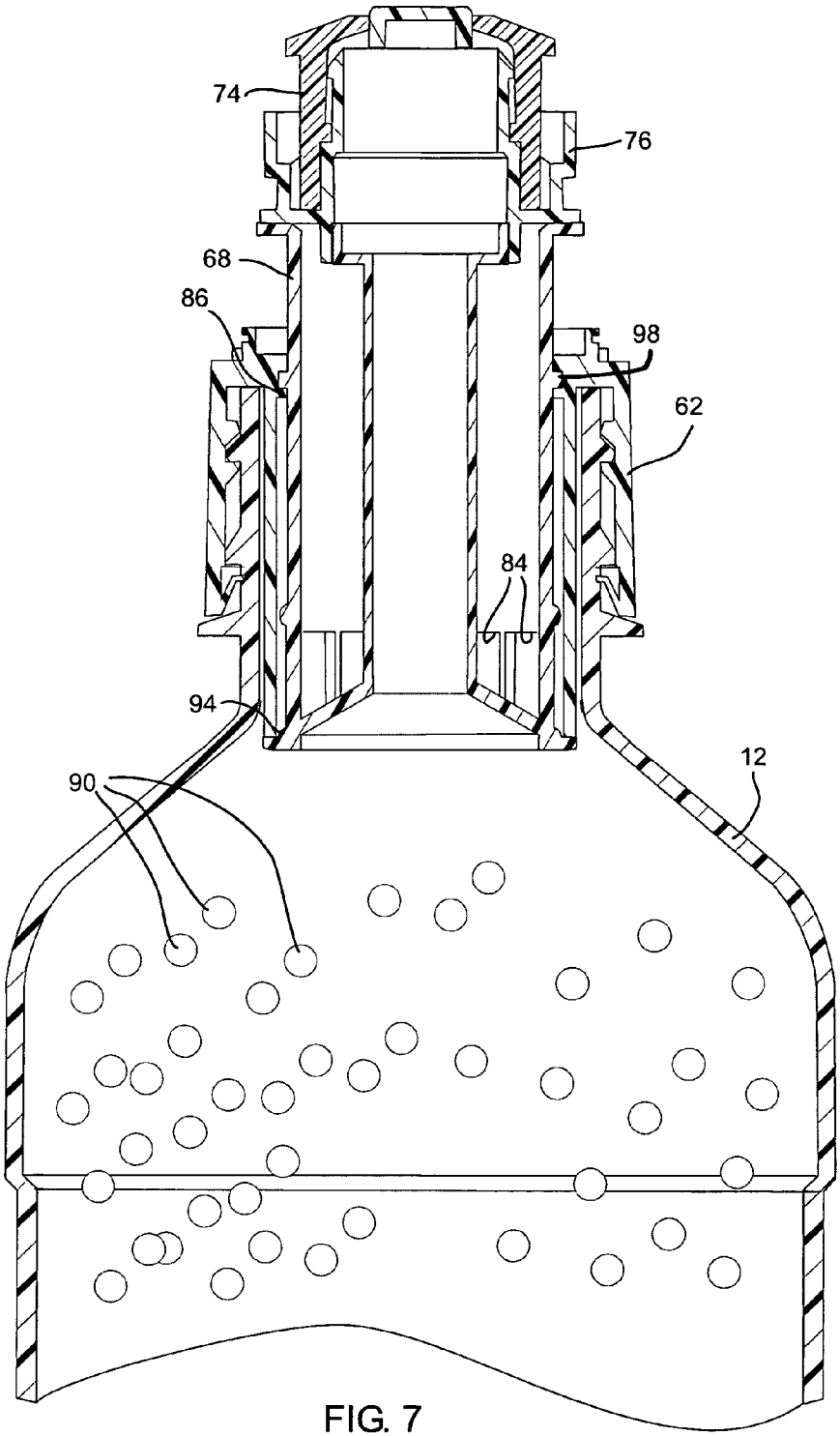
FIG. 7 is a cross-sectional view of the cap of FIG. 5 with the movable member of the device retracted back into the original position.
Figure 8:
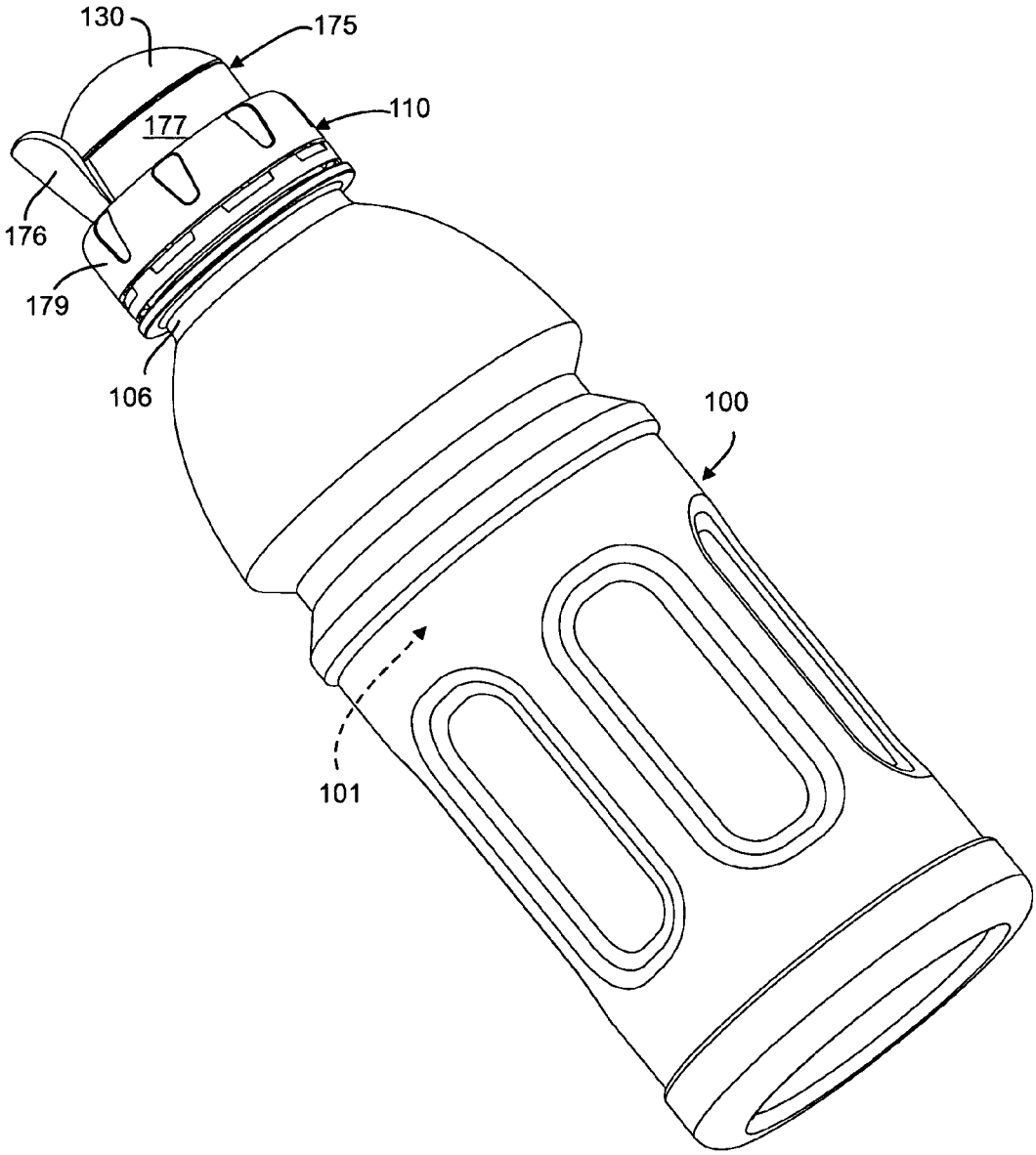
FIG. 8 is a perspective view of a third embodiment of the container invention.

A second embodiment of the device of the present invention is depicted in FIGS. 5-7. In the second embodiment of the invention, the dispensing closure 58 has means of utilizing the mixed components without removing the closure from the main package, namely a liquid dispensing nozzle or sipper 66. To create this feature, the movable member or first component holder 68 has been modified, as shown in FIG. 5, to include a sipper tube 70, sipper cap 72 provided with a sipper pull sleeve 74 and a serrated pull ring 76.

The outside of the first component holder 68 is similar to the first embodiment and includes a lock ring 86 and two seal rings 88. The first component holder/sipper cap assembly can also include desiccant granules (not shown) held in place by wire or plastic mesh, in case that the first component is moisture sensitive.

FIG. 6 shows the device in the activated position. At this point the user has removed the protective cap 64 by snapping it off and pushing the first component holder 68 all the way until the top flange 78 bottoms out against the container cap seat 82. The openings 84 between the seal rings 88, constituting the dispensing end of the first component holder 68 and are below the inner wall of the sipper cap 62. The first component 90 is then released into the container 12. The dispensing end of the first component holder 68 is also tapered 96 to accelerate the dispensing process.

FIG. 7 shows the device in the operating position when the mixed components are ready for use or consumption. Using the serrated pull ring 92, the first component holder 68 is brought back in the initial position when the lock ring 86 of the first component holder interlocks with the corresponding groove 98 in the sipper cap 62. Since the first component holder 68 needs to move both ways in this embodiment, the lock ring 86 and the lock groove 98 are rounded. To prevent the accidental removal of the first component holder 68 from the sipper cap 62, a safety flange 94 is added to the first component holder after insertion into the container cap.

In this position the openings to the dispensing end 84 are sealed again and liquid can not become trapped between the outer and inner wall of the first component holder 68 when the bottle is tilted or turned upside down. The final step is to raise the sipper pull sleeve 74 in the up position and the mixed components are ready for use or consumption. Alternate embodiments of this invention, not shown on drawings include a piercing tip/bellows combination, twist cap, pull cap with or without sipper.

With respect to a piercing tip/bellows combination, this particular embodiment of the invention uses a bellows type actuator to perform the first component dispensing. The piercing tip is attached to the top of the bellows while the bottom of the bellows is attached to the container cap. The first component granules or powder are stored inside the bellows, which is in the extended position. The bottom of the bellows is sealed from the supplemental component by a foil seal, membrane or any other material that is easy to perforate when enough force is applied to the piercing tip. Removing the protective cap and pushing down on the top of the bellows will cause the piercing tip to perforate the seal and release the first component into the main package. This embodiment uses a bellows type actuator.

In an embodiment, the invention may include a twist cap invention. This embodiment of the invention consists of a container cap that has a circular array of release holes on the periphery. In the center of the cap there are a number of cylindrical pins. A mating twist cap is attached to the container cap by means of a retaining plate or other fastening method. The twist cap has a series of kidney shaped holes in the center that line up with the cylindrical pins in the container cap. This holes allow only a limited amount of rotation of the twist cap. Also a number of pockets, correspondent to the number of release holes in the container cap, are built into the twist cap. Each pocket has an annular seal that provides an air tight environment for the first component. First component granules or tablets are inserted into these pockets prior to attaching the twist cap to the container cap. When the two components are assembled, the pockets are offset such as they are resting in between the release holes of the container cap and sealed against its flat surface. Rotating the twist cap until the cylindrical pins of the container cap bottom out on the kidney shaped holes of the twist cap, allow the pockets in the twist cap to line up with the release holes in the container cap thus dispensing the first component into the supplemental component.

In an embodiment, the invention may include a pull cap (with or without sipper). This embodiment of the invention is similar to the first aforementioned two preferred embodiments, except that the dispensing of the first component into the supplemental component motion is reversed and a pull action is used instead of push. Removing the protective cap and pulling a plug up above the narrow part of a funnel shaped first component holder, allows the first component to be dispensed into the main package. The second embodiment of this alternate version provides a liquid dispensing nozzle or sipper that allows utilization of the mixed components without removing the closure from the main package.

Turning to FIGS. 8-13, a third embodiment of the present invention is depicted. A container main body 100 forms a first chamber 101. In an embodiment, the container main body 100 may have the shape of well-known isotonic beverage or energy drink bottles and may be manufactured according to well-known methods of manufacturing such bottles. In an embodiment, the container main body 100 may be formed of a PET material and is filled by a room temperature or cooler fill process. The container main body 100 includes an opening 104 formed by a neck 106. In a preferred embodiment, the neck 106 is threaded.

A container cap 110 is mounted to the neck 106. In the preferred embodiment, the container cap 110 is threaded onto the neck 106. The cap 110 forms a second chamber 112 (see FIG. 11) that stores a component. In a preferred embodiment, the second chamber provides an air-tight seal to protect the component and allows the cap 110 or container 100 to be stored on a shelf without degradation or spoilage of the component. In an embodiment, a component such as a liquid is stored in the first chamber 101 of the main body 100. In an embodiment, the component in the first chamber 101 is water. In such an embodiment, the water only obtains a flavor or ingredient upon mixing of the supplemental component from the second chamber 112 and provides for a fresh mixture when the component (221, 222, 223) is mixed. However, prior to mixing with the component of the second chamber 112 the water has no ingredient that may degrade or spoil. Thus, the first chamber 101 does not need to be sealed in order to maintain the main component in the first chamber 101 or to avoid spoilage or degradation.

Therefore, it may be understood that the container main body 100, in an embodiment where the main body 100 first chamber 101 is filled with water, need not be manufactured in a high temperature fill method that acts to preserve the component and prevent spoilage. Thus, due to the storage of component in the sealed second chamber, the container main body 100 may be inexpensively manufactured (compared to other types of containers which may hold a liquid including flavors that must be filled on a high temperature, slow moving production line) without use of a multi-layered, heavy walled main body, or expansion panels. For example, it is believed that the present invention can save approximately 25 grams of PET material for each 20 ounce bottle, since no hot fill process is necessary. A standard hot fill 20 ounce bottle weighs approximately 40-50 g. A container 100 of the present invention (in a 20 ounce bottle) may weigh approximately 25-30 g. The present container 100 also reduces the need for heat resistant plastic inserts, allows for larger and smoother labeling surfaces and provides a transparent container to easily view component contents. The present container also eliminates use of additives such as sorbates, BHT, sulphur dioxide, benzoates, etc., while still providing an end product (after activation of the cap 110) that is fresh, such as an isotonic sports beverage or carbonated soft drink. The main body 100 can be made of a variety of low cost polymers such as recyclable PET and avoids undesirable side effects of hot filled bottles such as vacuum retention, label crinkle and bottle denting. The main body 100 eliminates need for heat setting or other means to increase crystallization ratio or glass transition (Tg) temperature. Locating the dispensing mechanism or plunger 120 on the cap 110, eliminates or diminishes the potential for residual product in the first chamber 101.

Figure 11:
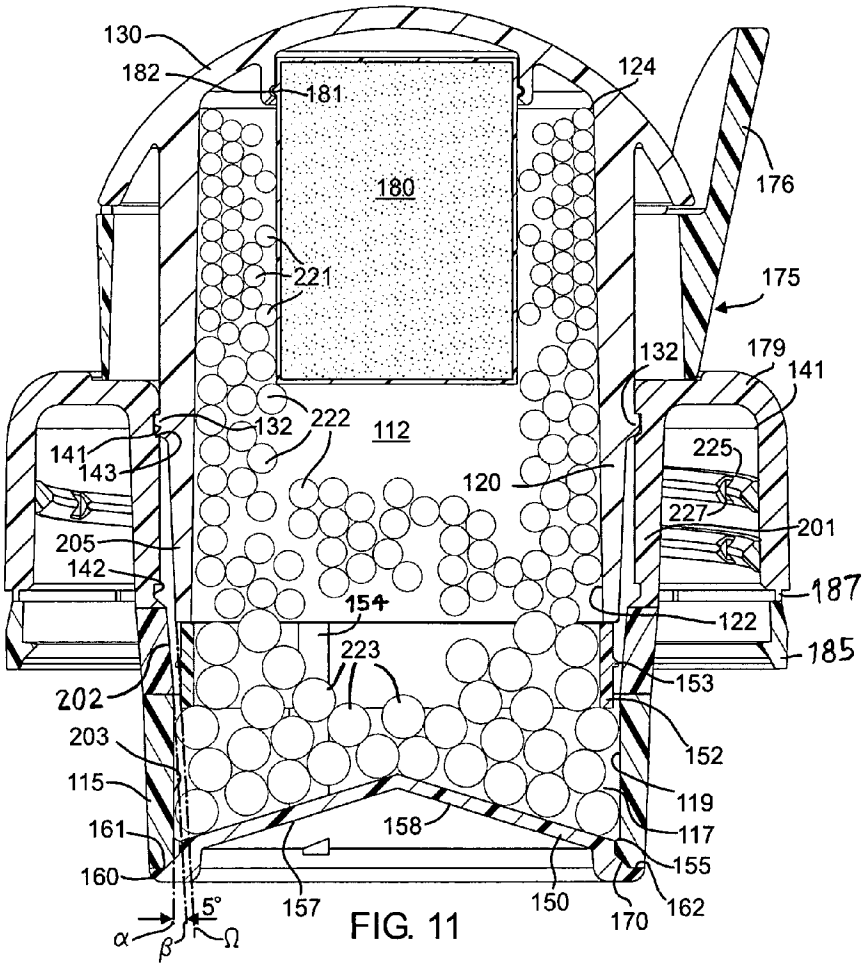
FIG. 11 is a sectional view taken at line 11-11 of FIG. 10.
Figure 10:
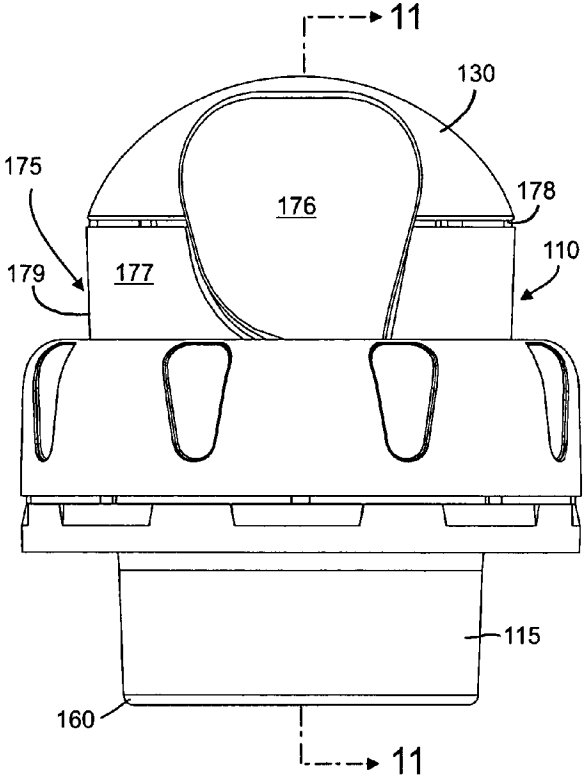
FIG. 10 is a side elevation view of the cap of FIG. 8.
Figure 13:
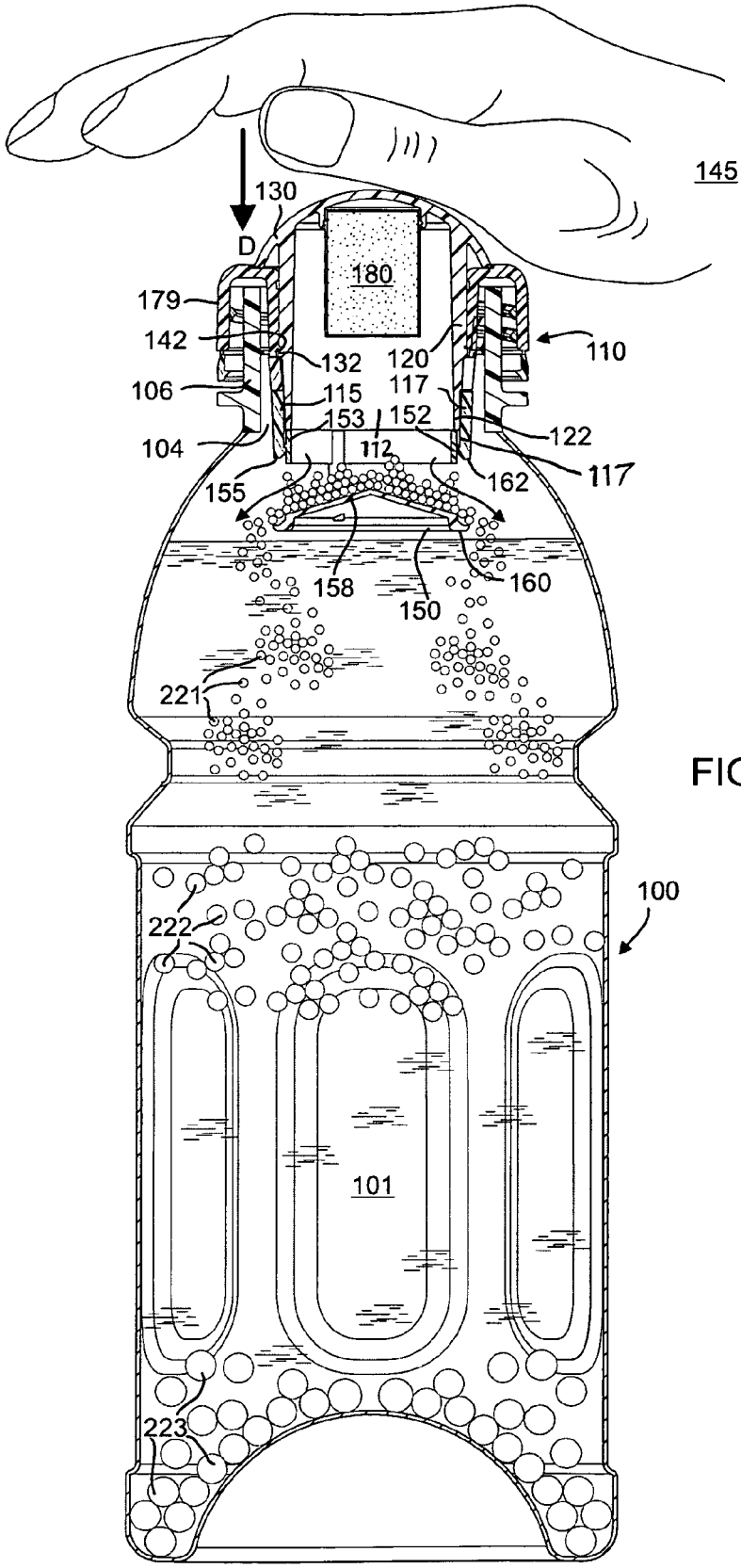
FIG. 13 is a sectional side elevation view of the container of FIG. 8 showing the cap in the activated condition.

The cap 110 includes a cap body 115 that forms a bore 117 having an inner wall 119. A plunger 120 is mounted in the bore 117. The plunger 120 includes an open end 122 and a closed end 124. The second chamber 112 is formed between the open end 122 and closed end 124 of the plunger 120. When the cap 110 is mounted to the main body 100, the open end 122 of the second chamber 112 is in communication with the opening 104 of the main body 100. The plunger 120 is reciprocatably mounted within the bore 117 and can be moved from a storage condition, as shown in FIG. 11, to an activated condition, as shown in FIG. 13.

The closed end 124 of the cap 110 is formed by a lid 130. In an embodiment, the lid 130 is dome shaped. The plunger 120 includes a locking member such as an annular flange 132. In an embodiment, the plunger 120, lid 130 and locking member 132 are all formed as one piece of an integrally molded polymer material forming a plunger assembly. The one piece plunger 120, having the lid 130 and locking member 132, provides for a rigid and robust construction which provides for a cap 110 that can be actuated in order to dispense a component from the second chamber 112 into the first chamber 101. In an embodiment the lid 130 is clear and the main body 100 is clear so that all components are visible in their unmixed stage at the point of purchase.

The cap body 115 inner wall 119 includes a first structure, such as first annular groove 141 and a second structure, such as a second annular groove 142 for receiving the annular flange 132. As shown in FIG. 11, the annular flange 132 engages the first annular groove 141, in order to lock the plunger 120 in the storage condition. As is shown in FIG. 13, the plunger is moved downward in direction of arrow D and the annular flange 132 engages the second annular groove 142 in order to lock the plunger 120 in the activated condition. In an embodiment, the annular groove 132 includes a tapered or beveled lower surface 143, so that the annular groove can slide easily downward along the inner wall 119 of the bore 117 and engage the second annular groove 142. In an embodiment, the barbed shape 143 of the annular flange 132 makes it possible to move the plunger 120 further into the bore 117 of cap body 115, but not in the other direction. This construction is important in establishing a tamper evident feature for the cap 100.

In an embodiment, the barbed shaped annular flange 132 is an integral part of the one piece plunger 120 and lid 130. The first and second annular groove 141, 142 also have a corresponding shape to the annular flange 132, so that the flange 132 may easily disengage from residing within the first groove 141 and move downward into the second groove 142. In an embodiment, the grooves 141, 142 each have a sharp upper edge 144 that restricts the movement of the plunger 120 in an upward direction (opposite Arrow D).

As is depicted in FIG. 13, an operator's hand 145 pushes downward on the lid 130 in the direction of arrow D which forces the plunger 120 downward from the storage condition to the activated condition and causes the annular flange 132 to move out of the first annular groove 141 downward into the second annular groove 142, which locks the plunger 120 in the activated condition. Once in the activated condition, as shown in FIG. 13, the annular flange 132 is engaged within the annular groove 142, so that it cannot be moved upward.

Figure 9:
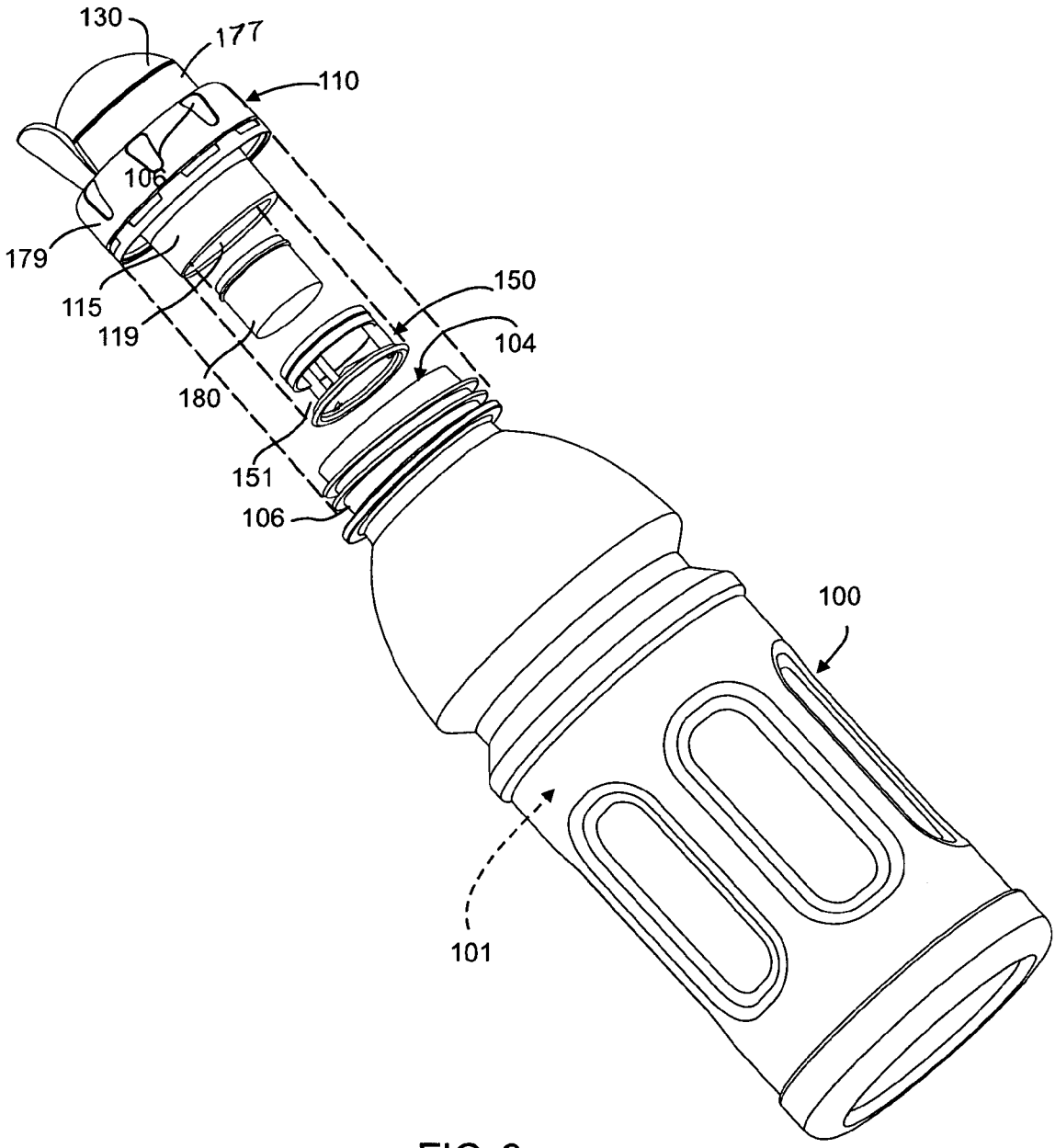
FIG. 9 is a perspective view of the container of FIG. 8 having the cap shown in an exploded view.
Figure 14:
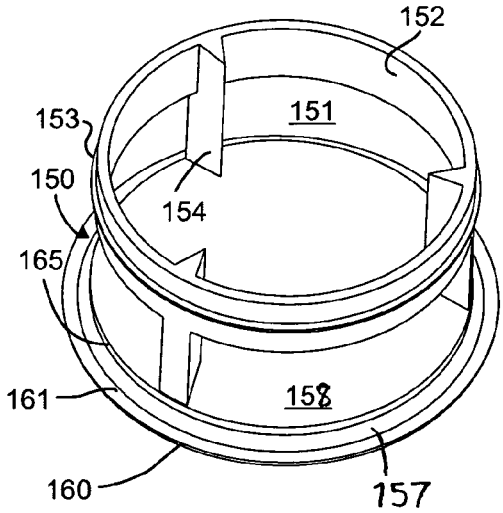
FIG. 14 is an enlarged perspective view of the dispenser tip of FIG. 9.

A dispensing tip 150 is mounted in the bore 117 adjacent the plunger 120. The dispensing tip 150 includes a cylindrical collar 152 including an annular ring 153. The annular ring 153 engages in annular lip of the inner diameter rim 155 formed at the open end of the cap body 115. The dispensing tip 150 forms apertures 151 formed by struts 154 radially oriented around the dispenser tip 150 (FIG. 14). In an embodiment, three struts 154 are provided and three apertures 151 are formed therebetween. As shown in FIGS. 9 and 11, the dispensing tip 150 is a separate component from the plunger 120. In an alternate embodiment, the dispensing tip 150 and plunger 120 may be attached and operate as a unit.

The dispensing tip 150 is activated by movement of the plunger 120 and reciprocates from a closed position, as shown in FIG. 11, to an open position as shown in FIG. 13. The dispensing tip 150 includes a transverse base 157 forming a conical upper surface 158 and an annular edge 160 forming a first flat sealing surface 161 (FIG. 14) which engages a second flat sealing surface 162 formed on an annular rim 163 of the cap body 115. In the closed position, as shown in FIG. 11, the annular edge 160 is adjacent the annular rim 163 and the first flat sealing surface 161 abuts the second flat sealing surface 162. In an embodiment, the second chamber 112 is sealed by the dispensing tip 150 when the first flat sealing surface 161 abuts the second flat sealing surface 162 via the mechanical locking of the compression fit between an outer diameter rim 165 of the dispensing tip being press-fit within the inner diameter rim 155 of the cap body 115. In an embodiment, the inner diameter rim 155 has a diameter that is slightly smaller than the outer diameter rim 165, so that upon insertion of the dispensing tip 150 within the bore 117, the cap body 115 is expanded slightly outward and provides a compression fit around the dispenser tip 150 in order to lock it in place and form a seal. In an embodiment, the seal is air tight and moisture resistant.

In an alternate embodiment, a seal may be formed between the first flat sealing surface 161 and the second flat sealing surface 162 via deformation of those surfaces. For example, a dielectric seal may be formed by imparting energy at the annular edge 160 and annular rim 163. In an embodiment, a sealing operation provides a dielectric seal which establishes a minimum pull force of approximately 250-1,000 grams, so that the seal of the dispensing tip may only be broken by generating a force greater than the pull force formed by the seal. The strength of the seal may be modified by altering the amount of energy transmitted to the first and second flat sealing surfaces 161, 162. Such a dielectric seal 170 may form a labyrinth seal in order to provide for a moisture seal and an air tight seal of the chamber 112 in order to prevent air and moisture from entering or exiting the second chamber 112 from the first chamber 101 or from outside the container 100 or cap 100.

Figure 12:
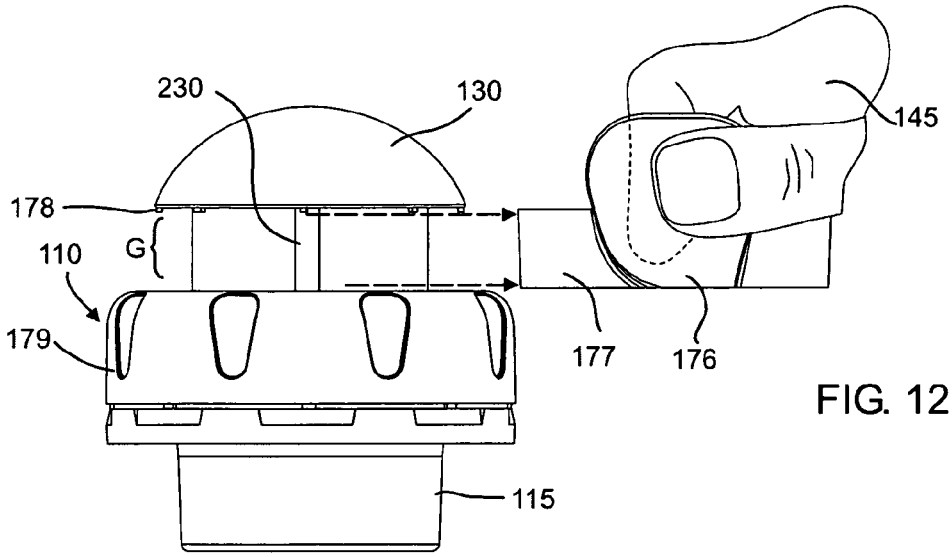
FIG. 12 is a side elevation view showing the removal of the tear strip from the cap of FIG. 8.

The cap body 115 also includes a pull tab or tear strip 175. The tear strip 175 includes a handle 176 and a compression barrier 177. A perforated area 178 provided adjacent a lower, outer edge of the lid 130 protruding from the plunger 120 that attaches the tear strip 175 to the cap 115 and plunger 120. In an embodiment, the tear strip 175 is integrally molded with the plunger 120. By pulling on the handle 176 in the direction of arrows A, as shown in FIG. 12, the compression barrier 177 is removed along the perforation 178 and forms a gap G between the lid 130 and an outer collar 179. Prior to removal of the tear strip 175, the compression barrier 177 forms a means of preventing the lid 130 from being moved downward in direction of arrow D, as shown in FIG. 13 and provides a compression barrier against activation of the cap 110. After the tear strip 175 is removed, the gap G allows the lid to be moved downward in order to move the plunger 120 to its activated condition as shown in FIG. 13. Therefore, it is also to be understood that the tear strip 175 provides for a tamper evident component that allows for visual indication that the cap 110 has been tampered with—when the tear strip 175 is missing. Such removal of the tamper evident component 175 would provide an indication that the seal 170 may have been broken and that the component within the second chamber 112 is no longer fresh or spoiled.

The cap 110 also includes a desicant container 180. In an embodiment, the container 180 is a cylinder and includes an annular finger 181 that is received by an annular neck 182 formed in the lid 130, so that the desicant cylinder 180 may be snap-fit in place into the lid 130. A desiccant filled cylinder 180 is provided to mitigate the effects of moisture penetration into the chamber 112, should it occur.

A drop ring 185 is mounted on the cap body 115 below the outer collar 179. Upon twisting the collar in order to remove the cap 110 from the neck 106 of the container body 100, the drop ring 185 has frangible posts 187 (FIG. 11) that are broken and cause the ring 185 to separate from the collar 179 that provides a visual cue that the container has been opened. Thus, the drop ring 185 provides another tamper indicator for the cap 110, in addition to the tear strip 175 discussed above.

In an embodiment, the cap body 115 includes the inner wall 119 including the upper, middle and lower wall sections 201, 202, 203 and the outer collar 179. In an embodiment, these components may all be integrally molded of a polymer material to provide a cap body assembly. The first and second annular grooves 141, 142, threads 225, vents 227 and drop ring 185 may also be molded as part of the cap body assembly.

The bore 117 formed by the inner wall 119 of the cap body 115, in an embodiment, includes an upper section 201, a middle section 202 and a lower section 203. In a preferred embodiment, the upper section 201 and lower section 203 have walls 119 formed that are parallel to the linear axis of the bore 117. As shown in FIG. 11, line a indicates the outer wall 203 of the lower section which is parallel to the linear axis of the cap body 115. In an embodiment, the middle section 202 is tapered and line β indicates the taper of the middle section 202 of the wall 119. As shown in FIG. 11, the angle between the linear wall at the lower section 203 and the middle section 202 is approximately 5°. In an embodiment, the plunger 120 includes a lower portion 205 that is also tapered at approximately 5° (shown by line Ω) with respect to the wall 203. Therefore, the cap body 115 includes an outer plunger wall 202 that is tapered correspondingly to a lower portion inner wall 205 of the plunger 120 and form a luer lock when they are abutting each other, as shown in FIG. 13. This luer lock causes the plunger 120 to be maintained in the activated condition, so that the plunger 120 cannot be moved upward (in the opposite direction of arrow D as shown in FIG. 13).

Thus, it is to be understood that both the annular flange 132 locked in the annular groove 142 and the outer plunger wall 22 engaging the inner tapered wall 205, act simultaneously to lock the plunger 120 in the activated condition, so that the plunger may not be deactivated or moved backwards into the stored condition. In an embodiment, both features act to maintain the plunger in the activated condition. In an alternate embodiment, the cap 110 may be designed so that only the luer locking effect of the tapered walls maintains the plunger in the activated condition. In a further alternate embodiment, the cap 110 may be designed so that only the annular flange 132 locked in the annular groove 142 maintains the plunger 120 in the activated condition. Although it helps to lock the plunger in the activated condition, the primary purpose for the tapered plunger is to create a "corking" or lever feature so the pressure created by the effervescent tablets or otherwise carbonated or pressurized liquid can't escape through the cap assembly. The tapered five degree plunger 120 and bore wall 202 is an integral part of the plunger 120, lid 130, and locking means. Building this feature into the plunger 120 affords inexpensive manufacture and eliminates the need for an additional seal component.

In an embodiment, the second chamber 112 is filled with a component such as granules or tablets including Creatine, wolfberry, calcium, guarine, arginine, Vitamins B, B12, C, D, ibuprofen, electrolytes, niacin, folic acid, biotin, choline bitartate, inositol, manganese, calcium, Saint John's wart, yohimbe, chromium polynicotinate, carnitine, taurine, astragulus, schizandra, kava kava, lemon grass, Echinacea, prolione, bee pollen, amino acids, chitin oligomers, water soluble oral chitosan oligomers and zinc, among others. As shown in FIG. 11, the component may comprise granules having different sizes and weights. For example, a first component 221, a supplemental component 222 and a third component 223 are depicted. In an embodiment, the first component 221 weighs approximately 0.10-0.50 grams, the supplemental component 222 weighs approximately 0.15-0.75 grams and the third component 223 weighs approximately 0.20-1.0 grams. In the stored condition, as shown in FIG. 11, the component may be disbursed by weight/size within the chamber 112. In an alternate embodiment, the first, second and third component 221, 222, 223 may be disbursed randomly throughout the chamber 112. It is also to be understood that in other embodiments the chamber 112 may include a single component having one size and shape, two components having two sizes and shapes or any number or combination of components having different sizes and shapes. In a further alternate embodiment, the component in the second chamber 112 may be a powder, liquid, gas, slurry or other particles.

As shown in FIG. 13, upon movement of the plunger from the stored condition to the activated condition, the dispenser tip is moved to the open position and the component is dispensed into the first chamber 101. Due to the different sizes and weights of the components 221, 222, 223 they will be dispensed into the liquid at different rates of descent and in different locations. As shown in FIG. 13, the first component 221 is disbursed to the upper portion of the container main body 100, the supplemental component 222 is disbursed towards the middle of the main body 100 and the third and heaviest component 223 is dispensed towards the bottom of the main body of the container 100. In this way the different sized and weighted components 221, 222, 223 are disbursed throughout the different areas of the chamber 101. In an embodiment, the component provides for an effervescent action and the effervescence will occur throughout the entire chamber 101 based on the dispersion of the different sized and weighted components 221, 222, 223. The use of effervescent tablets 221 in conjunction with the delivery system provides strong refreshment cues such as a "fizz" sound, active bubbles, a unique and apparent reaction and a visible change of state (solid to liquid) for the contents of the chamber 101. In an alternate embodiment, the components may have different shapes. As shown in FIG. 13, the component are sphere-like granules. In an alternate embodiment, cube-shaped granules may be provided so that the rate at which the granules effervesce is different and also so that the different shaped granules will descend through the liquid at different rates and locate and be disbursed in different parts of the chamber 101. All of these modifications in the size, weight and shape of the component will provide a more disbursed effervescent visual effect through the chamber 101, providing for a more satisfactory experience for the user of the bottle.

Figure 15:
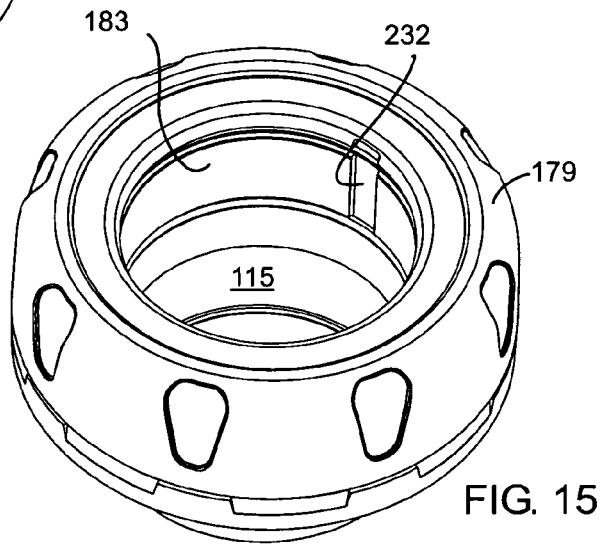
FIG. 15 is an enlarged perspective view of the cap body and outer collar of FIG. 10 with the lid/plunger removed.

The cap 110 also includes a locking lug 230 (FIG. 12) of the plunger 120 that protrudes and is received in a keyway 232 (FIG. 15), formed as a recess in the collar 174 inner wall 183, in order to prevent rotation of the plunger within the cap body 115. The one piece plunger 120 incorporates in an embodiment two external locking lugs 230 which prevent the plunger 120 from turning or spinning along its central axis when the tear strip 175 is removed. Without these lugs 230 the plunger 120 would rotate relative to the cap body 115 during removal of the tear strip 175. In an embodiment, there are two lugs 230 on the plunger 120 and two corresponding key ways 232 on the cap body 115. In an alternate embodiment, there could be more or less lugs/keyways that prevent the plunger 120 from spinning relative to the cap 115.

In a preferred method of assembling the container of the present invention, the cap 110 is assembled separately from the main body 100. The one piece plunger 120, and lid 130 are mounted on the cap body 115 thereon. The desicant cylinder 180 is then snap fit within the chamber 112. The cap body 115 is then inverted so that the bore 117 is facing upward. An automated process of filling the chamber 112 with a component 221, 222, 223 may be provided such as via a conveyor belt filling process or an automated fill nozzle. After filling the chamber 112 with component, the dispensing tip 150 is then inserted into the bore 117. The dispensing tip 150 may be sealed onto the cap body 115 according to the means discussed above, including mechanically or via dielectric seal. The plunger assembly 120 and cap body 115 are filled with component 221, 222, 223, and united via the annular flange 132 received in annular groove 141 and the outer diameter rim 165 of the dispenser tip 150 engaging the inner diameter rim 155 of the cap body 115 in order to provide an air tight chamber 112. The plunger assembly 120 and cap body 115 cannot be separated, prior to removal of the tear strip 175, without destroying each part 115, 120. As well, after removal of the tear strip 175, the plunger assembly 120 can reciprocate within the cap body; however, the two parts still cannot be separated, without destroying each part 115, 120. The cap 110 may then be assembled onto the main body 100 or it may be sold separately for situations where customers may wish to have different flavored or different types of caps to place onto separately purchased bottles of liquid, such as water. Because the external shape of the cap 110 is round, it facilitates use on existing capping equipment and does not require orientation or indexing. The ability to separate the cap 110 and bottle main body 100 prior to mixing, affords the ability for consumers to adjust the concentration of the mixture by reducing the amount of liquid in the bottle prior to mixing. The ability to separate cap 110 and bottle main body 100 prior to mixing, also affords the ability for consumers to use the first chamber 101 contents independent of the contents of the component 221, 222, 223.

In an embodiment, the dispensing tip construction will work in the following combinations: a) with the die-electric seal and without the annular snap ring seal; b) with the annular snap ring seal and without the die-electric seal; or c) with both the die-electric seal and the annular snap ring seal. The preferred embodiment depends on the application and sensitivity of the chamber or bottle contents. In addition to providing an easily adjustable secondary seal, the separation of dielectrically bonded "horizontal flats" will also contribute to a signature "POP" sound.

The separation of the lower annular snap ring seal along with the separation of the upper annular lock ring creates a "POP" sound, audible during plunger 120 actuation. The combination of the two annular snap rings/lock rings 132/141, 165/155 overcoming their interference fits results in the "POP" sound. In addition the rapid separation of the lower seal 170 equalizes the pressure within the chamber and bottle further contributing to the "POP" sound. The "POP" sound is a audible, mnemonic feature which, in an embodiment differentiates and identifies the closure system of the present invention. A distinctive plunger "smack" operation, sound and action also differentiates the invention, in an embodiment, and creates a new, and novel interaction between the consumer and the product.

When the cap 110 is placed onto the cap body 100, the outer collar 179 includes threads 225 including vents 227 which engage the threads of the neck 106 of the main body 100 for attachment thereto. After the cap body 110 is assembled to the main body 100, the completed assembly is shipped to a store and purchased by an end user. The closure's seal with the bottle is air tight. The content of the dispensing chamber 112 is maintained in an airtight condition until the plunger is actuated. The mixed content of the chamber 112 and bottle 100 is also maintained in an airtight condition until the cap 110 is unscrewed and removed from the bottle.

The preferred method of operating the cap end container assembly is as follows. The operator lifts the container body 100 and removes the tear strip 175 by grabbing the handle 176 and pulling it away from the cap body 115, so that the compression barrier 177 is removed along the perforated edge 178 and providing a gap G, as shown in FIG. 12. The operator strikes downward on the lid 130 in direction of arrow D with the palm, as shown in FIG. 13. This striking action pushes the lid 130 downward (closing the gap G) and generates a push force of approximately 1500 to 3000 grams and causes the plunger 120 to move from the storage condition (FIG. 11) to the activated condition (FIG. 13). The lower edge 122 of the plunger pushes against the upper collar 152 of the dispenser tip 150 causing it to move from the closed to the open position, as shown in FIG. 13. In an embodiment, the striking of the lid 130 with the palm of the user's hand 145 causes a "smack" sound. The lid 130 is formed having a flat dome shape to accentuate the "smack" sound. The telescoping construction of the plunger 120 within the cap body 115 allows for the lid 130 to be compressed and create a physically smaller overall package that contributes to an appearance of less material and waste and a more eco-friendly package.

As well, an embodiment the dispenser tip 150 is designed to make a sound when it is activated. For example, the breaking of the seal 170 may cause a "pop" sound when the seal is broken and air rushes into the chamber 112. Further, upon movement of the plunger 120 from the storage condition to the activated condition the compression of the beveled face 143 of the flange 132 may also provide a "pop" sound. Therefore, each of these audible sounds will provide for an alarm to the operator that the seal 170 has been broken and the component of the chamber 112 is being released. In an embodiment, all three of these sounds can occur simultaneously to provide a unique experience for the user and provide an exciting audible feature to indicate that the component in the chamber 112 is being released. In alternate embodiments, none, one or two of these audible features may be provided.

Once in the open position, the dispenser tip 150 allows for the component 221, 222, 223 to be easily dispensed from the chamber 112 by rolling down the conical shaped surface 158, through the apertures 151 and out of the cap body 115 into the chamber 101 where the component 221, 222, 223 may mix with the other component, such as liquid. As discussed above, the full effervescence may be achieved throughout the liquid in chamber 101, in order to provide for additional excitement for the operator.

In an embodiment, the bottle 100 can be resealed using the closure system 106, 225 whether the plunger 120 is in its actuated or un-actuated state. In an embodiment, the neck of mouth surface 106 of the main body 100 is covered by closure assembly cap 110 and remains "clean" until the cap 110 is unscrewed and removed. This is a helpful feature because all aluminum beverage cans and many sport caps have exposed mouth surfaces. After the closure mechanism is in the activated condition the compressed plunger 120 and cap assembly 110 provides all the functions of a traditional re-sealable closure.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A cap comprising:

a cap body of one piece construction including a bore;

a dispensing tip associated with a lower portion of the cap body forming a closed end at a lower portion of the bore and forming a seal resistant to passage of air and moisture with the cap body;

a plunger of rigid construction, the plunger including a hollow portion, a lid forming a closed end and an open end, the plunger and lid being formed of one piece;

the plunger being positioned within the cap body forming a chamber between the closed end of the plunger and the closed end of the bore, and the chamber including the hollow portion of the plunger with the open end of the plunger being located in the chamber;

at least one component contained within the chamber;

the plunger being movable from a storage position to an activated position to move the dispensing tip to an open position breaking the seal so that the at least one component can exit the chamber; and the dispensing tip including apertures, and moving of the dispensing tip to an open position breaking the seal includes movement of the dispensing tip so that the at least one component can flow through the apertures.

2. The cap according to claim 1, wherein the plunger and the cap body include locking elements to maintain the plunger in the storage position, and permit movement of the plunger to the activated position.

3. The cap according to claim 2, wherein the locking elements restrict movement of the plunger in a direction that permits separation of the cap body and the plunger.

4. The cap according to claim 2, wherein the locking elements comprise flange and groove elements.

5. The cap according to claim 4, wherein the flange and groove elements comprise a flange on the plunger and a groove on the cap body.

6. The cap according to claim 2, wherein the locking elements maintain the plunger in the activated position after the plunger is moved from the storage position to the activated positioned.

7. The cap according to claim 6, wherein the locking elements comprise flange and groove elements.

8. The cap according to claim 7, wherein the flange and groove elements comprise a flange on the plunger and the cap body includes a groove associated with the storage position and another groove associated with the activated position.

9. The cap according to claim 8, wherein the flange and grooves are constructed and arranged to restrict movement of the plunger from the grooves in a direction that permits separation of the cap body and the plunger.

10. The cap according to claim 1, wherein the cap body includes an inwardly tapered internal wall.

11. The cap according to claim 10, wherein the plunger includes a tapered wall frictionally cooperating with the tapered wall of the cap body.

12. The cap according to claim 1, wherein the dispensing tip is formed of a polymer material.

13. The cap according to claim 1, wherein the apertures are located at a periphery of the dispensing tip so that the at least one component can flow outwardly from the chamber.

14. The cap according to claim 13, wherein the apertures are spaced around the periphery of the dispensing tip.

15. The cap according to claim 1 wherein the dispensing tip includes a transverse base member comprising a generally conical shaped surface.

16. The cap according to claim 15, wherein an edge portion of the generally conical shaped surface is separated from the cap body when the seal is broken.

17. The cap according to claim 16, wherein, in the activated position, the plunger, the cap body and the dispensing tip comprise an integral unit.

18. The cap according to claim 13, wherein, in the activated position, the plunger, the cap body and the dispensing tip comprise an integral unit.

19. The cap according to claim 1, wherein the at least one component comprises a plurality of components having at least two different characteristics.

20. The cap according to claim 19, wherein the at least two different characteristics provide different visual effects.

21. The cap according to claim 20, wherein the at least two different characteristics comprise at least a difference in at least one of size, shape and weight.

22. The cap according to claim 1, wherein the at least one component comprises a plurality of components having at least two different characteristics, and the at least two different characteristics comprise at least a difference in at least one of size, shape and weight.

23. The cap according to claim 1, wherein the lid is dome shaped.

24. The cap according to claim 1, wherein the cap body of one piece construction further includes a portion for attaching the cap body to a container so that the at least one component can flow into the container in the activated position.

25. In combination, the cap according to claim 24 with a container.

26. The combination according to claim 25, wherein the container is formed of a single wall material.

27. The cap according to claim 24, wherein the portion for attaching the cap body to a container comprises a threaded portion.

28. The cap according to claim 27, further including at least one vent in the threaded portion.

29. The cap according to claim 1, wherein the plunger is mounted for vertical movement between the storage position and the activated position.

30. The cap according to claim 1, further including elements to prevent rotation of the plunger.

31. The cap according to claim 1, wherein the cap body is of rigid construction.

32. The cap according to claim 13, wherein the plunger includes a wall surrounding the hollow portion, and the wall contacts the periphery of the dispensing tip to break to the seal.

33. The cap according to claim 1, wherein the dispensing tip and the cap body comprise one piece; the cap body comprising a wall surrounding a hollow portion forming at least a portion of the chamber; a peripheral portion of the dispensing tip being attached to a lower portion of the wall forming a lower portion of the chamber; and the plunger being movable between the storage position and the activated position to break the seal formed by the dispensing tip and the cap body along an entirety of the peripheral portion.

34. The cap according to claim 33, wherein, in the activated position, the plunger, the cap body and the dispensing tip comprise an integral unit.

35. The cap according to claim 23, wherein the dome-shaped lid abuts against an upper surface of the cap body in the activated position.

36. The cap according to claim 1, further including a dispensing member.

37. The cap according to claim 1, wherein the seal comprises an annular snap ring seal.

38. The combination according to claim 25, wherein the container includes a neck portion and, in the activated position, the at least one component can exit the chamber below the neck portion of the container.

39. A method of applying a cap to a container comprising applying the cap of claim 1 to the container.

40. A cap comprising:

a cap body of one piece construction including a bore;

a dispensing tip associated with a lower portion of the cap body forming a closed end at a lower portion of the bore and forming a seal resistant to passage of air and moisture with the cap body;

a plunger of rigid construction, the plunger including a hollow portion, a lid forming a closed end and an open end, the plunger and lid being formed of one piece;

the plunger being positioned within the cap body forming a chamber between the closed end of the plunger and the closed end of the bore, and the chamber including the hollow portion of the plunger with the open end of the plunger being located in the chamber;

at least one component contained within the chamber;

the plunger being movable from a storage position to an activated position to move the dispensing tip to an open position breaking the seal so that the at least one component can exit the chamber; and a tear strip which provides a compression barrier in order to maintain the lid in the storage condition and provides tamper evidence by providing a visible indication once the tear strip is removed.

41. The cap according to claim 40, wherein the dispensing tip includes apertures, and moving of the dispensing tip to an open position breaking the seal includes movement of the dispensing tip so that the at least one component can flow through the apertures.

42. The cap according to claim 40, wherein the cap body of one piece construction further includes a portion for attaching the cap body to a container so that the at least one component can flow into the container in the activated position.

43. In combination, the cap according to claim 42 with a container.

44. A method of applying a cap to a container comprising applying the cap of claim 40 to the container.

45. A cap comprising:

a cap body of one piece construction including a bore;

a dispensing tip associated with a lower portion of the cap body forming a closed end at a lower portion of the bore and forming a seal resistant to passage of air and moisture with the cap body;

a plunger of rigid construction, the plunger including a hollow portion, a lid forming a closed end and an open end, the plunger and lid being formed of one piece;

the plunger being positioned within the cap body forming a chamber between the closed end of the plunger and the closed end of the bore, and the chamber including the hollow portion of the plunger with the open end of the plunger being located in the chamber;

at least one component contained within the chamber;

the plunger being movable from a storage position to an activated position to move the dispensing tip to an open position breaking the seal so that the at least one component can exit the chamber;

the plunger and the cap body including locking elements to maintain the plunger in the storage position, and permit movement of the plunger to the activated position;

the dispensing tip including apertures through which the at least one component can flow subsequent to breaking of the seal;

the apertures being located at a periphery of the dispensing tip so that the at least one component can flow outwardly from the chamber; and in the activated position, the plunger, the cap body and dispensing tip comprise an integral unit.

46. A method of activating a cap on a container, the cap comprising:

a cap body of one piece construction including a bore;

a dispensing tip associated with a lower portion of the cap body forming a closed end at a lower portion of the bore and forming a seal resistant to passage of air and moisture with the cap body;

a plunger of rigid construction, the plunger including a hollow portion, a lid forming a closed end and an open end, the plunger and lid being formed of one piece;

the plunger being positioned within the cap body forming a chamber between the closed end of the plunger and the closed end of the bore, and the chamber including the hollow portion of the plunger with the open end of the plunger being located in the chamber;

at least one component contained within the chamber;

the plunger being movable from a storage position to an activated position to move the dispensing tip to an open position breaking the seal so that the at least one component can exit the chamber; and the dispensing tip including apertures, and moving of the dispensing tip to an open position breaking the seal includes movement of the dispensing tip so that the at least one component can flow through the apertures;

the method comprising pushing the lid of the plunger to move the plunger from the storage position to the activated position to move the dispensing tip to the open position breaking the seal so that the at least one component exits the chamber.

47. The method according to claim 46, wherein the dispensing tip includes apertures, and the dispensing tip is moved to the open position breaking the seal so that the at least one component flows through the apertures.

48. The method according to claim 47, wherein the dispensing tip includes a transverse base member comprising a generally conical shaped surface.

49. A method of activating a cap on a container, the cap comprising:

a cap body of one piece construction including a bore;

a dispensing tip associated with a lower portion of the cap body forming a closed end at a lower portion of the bore and forming a seal resistant to passage of air and moisture with the cap body;

a plunger of rigid construction, the plunger including a hollow portion, a lid forming a closed end and an open end, the plunger and lid being formed of one piece;

the plunger being positioned within the cap body forming a chamber between the closed end of the plunger and the closed end of the bore, and the chamber including the hollow portion of the plunger with the open end of the plunger being located in the chamber;

at least one component contained within the chamber;

the plunger being movable from a storage position to an activated position to move the dispensing tip to an open position breaking the seal so that the at least one component can exit the chamber; and a tear strip which provides a compression barrier in order to maintain the lid in the storage condition and provides tamper evidence by providing a visible indication once the tear strip is removed;

the method comprising removing the tear strip and pushing the lid of the plunger to move the plunger from the storage position to the activated position to move the dispensing tip to the open position breaking the seal so that the at least one component exits the chamber.

* * * * *